US007306138B2

(12) United States Patent
Shadrach

(10) Patent No.: US 7,306,138 B2
(45) Date of Patent: Dec. 11, 2007

(54) PRODUCT DISPENSING APPARATUS, GATE AND METHODS FOR ASSEMBLING AND USING SAME

(76) Inventor: William S. Shadrach, 2239 Emerson Ave., Salt Lake City, UT (US) 84118

( * ) Notice: Subject to any disclaimer, the term of this patent is extended or adjusted under 35 U.S.C. 154(b) by 425 days.

(21) Appl. No.: 11/003,634

(22) Filed: Dec. 3, 2004

(65) Prior Publication Data

US 2005/0082356 A1 Apr. 21, 2005

Related U.S. Application Data

(63) Continuation-in-part of application No. 10/305,685, filed on Nov. 26, 2002, now abandoned.

(51) Int. Cl.
*B05D 5/72* (2006.01)

(52) U.S. Cl. ..... 229/122.1; 229/220; 229/125.12

(58) Field of Classification Search ..... 229/220, 229/125.12, 116.1, 116.3, 102, 122.1; 206/815
See application file for complete search history.

(56) References Cited

U.S. PATENT DOCUMENTS

| | | | | |
|---|---|---|---|---|
| 7,371 | A | * | 5/1850 | Maginn |
| 155,204 | A | | 9/1874 | Robeson |
| 240,137 | A | | 4/1881 | Isham |
| 344,126 | A | | 6/1886 | Meaker |
| 916,503 | A | * | 3/1909 | Thompson |
| 916,986 | A | * | 4/1909 | Bopp |
| 997,063 | A | | 7/1911 | Hordich |
| 1,007,390 | A | | 10/1911 | Robinson |
| 1,167,768 | A | | 1/1916 | Lochner |
| 1,257,067 | A | * | 2/1918 | Billstein |
| 1,628,439 | A | | 5/1927 | Staubly |
| 1,951,274 | A | | 3/1934 | Denman |
| 1,972,406 | A | | 9/1934 | Marsh |
| 1,986,395 | A | | 1/1935 | Hails |
| 1,998,862 | A | | 4/1935 | Caruso et al. |
| 2,349,748 | A | | 5/1944 | Otto |
| 2,393,356 | A | * | 1/1946 | Fallert ..... 229/125.26 |
| 2,486,045 | A | | 10/1949 | Madden, III |
| 2,722,309 | A | | 11/1955 | Waterman |
| 2,884,177 | A | | 4/1959 | Hull |
| 2,903,175 | A | | 9/1959 | Peimer |
| 2,950,821 | A | | 8/1960 | Peimer |
| 3,033,436 | A | | 5/1962 | Peimer |
| 3,040,953 | A | | 6/1962 | Tindall |
| 3,092,298 | A | * | 6/1963 | Scholle ..... 229/126 |
| 3,186,591 | A | | 6/1965 | Solomon |
| 3,367,491 | A | | 2/1968 | Dunham et al. |

(Continued)

*Primary Examiner*—Tri M. Mai
(74) *Attorney, Agent, or Firm*—Morriss O'Bryant Compagni

(57) ABSTRACT

Embodiments of a product dispensing apparatus, gate and methods for assembling and using are disclosed. A particularly, useful feature of the embodiments is a movable gate having tabs with perforation which may be formed as part of a unitary body configured for assembly into a product dispensing apparatus. According to an additional feature, the gate may be configured to separate from the tabs upon first use and then be used to open and close or at least partially close a portal for accessing products within the product dispensing apparatus. According to other features, the gate may also be configured to slide up and down, from side-to-side or move within a channel formed in part by the tabs at the perforations and by other gate-enclosing panels.

20 Claims, 14 Drawing Sheets

U.S. PATENT DOCUMENTS

| | | | | |
|---|---|---|---|---|
| 3,515,332 | A | | 6/1970 | Smith |
| 3,819,093 | A | | 6/1974 | Forbes |
| 4,043,095 | A | | 8/1977 | Graser |
| 4,081,128 | A | | 3/1978 | O'Neill |
| 4,138,041 | A | | 2/1979 | Capo et al. |
| 4,154,365 | A | | 5/1979 | Lorca |
| 4,155,449 | A | | 5/1979 | Bryne |
| 4,197,985 | A | | 4/1980 | Austin |
| 4,201,329 | A | * | 5/1980 | Roccaforte |
| 4,478,334 | A | | 10/1984 | Graser |
| 4,508,258 | A | | 4/1985 | Graser |
| 4,609,142 | A | | 9/1986 | Adamek |
| 4,658,984 | A | | 4/1987 | Brunner |
| 4,671,405 | A | * | 6/1987 | Hagan |
| 4,679,725 | A | | 7/1987 | Wilson |
| 4,706,876 | A | | 11/1987 | Wilson |
| 4,728,026 | A | | 3/1988 | Schuster |
| 4,785,991 | A | | 11/1988 | Schuster |
| 4,811,894 | A | | 3/1989 | Schuster |
| 4,830,267 | A | | 5/1989 | Wilson |
| 4,913,291 | A | | 4/1990 | Schuster |
| 4,953,707 | A | | 9/1990 | Wein |
| 5,020,668 | A | | 6/1991 | Schuster |
| 5,074,462 | A | | 12/1991 | Countee, Jr. |
| 5,480,249 | A | | 1/1996 | Kageyama et al. |
| 5,482,185 | A | * | 1/1996 | McNaughton |
| 5,505,373 | A | | 4/1996 | von Stillfried |
| 5,516,038 | A | | 5/1996 | Zaccarini |
| 5,878,947 | A | | 3/1999 | Hoy et al. |
| 6,273,332 | B1 | * | 8/2001 | Todjar-Hengami |
| 6,393,707 | B1 | * | 5/2002 | Maffei ..... 33/1 SD |
| 6,435,402 | B1 | * | 8/2002 | Hengami |
| 6,789,673 | B2 | | 9/2004 | Lingamfelter |

* cited by examiner

PRODUCT DISPENSING APPARATUS, GATE AND METHODS FOR ASSEMBLING AND USING SAME

CROSS-REFERENCE TO RELATED APPLICATION

This is a continuation-in-part (CIP) patent application of Ser. No. 10/305,685, filed Nov. 26, 2002, published as U.S. Patent Publication No. 20040099719 A1, May 27, 2004, abandoned, the contents of which are incorporated herein by reference for all purposes.

FIELD OF THE INVENTION

This invention relates generally to product dispensing apparatuses. More particularly, this invention relates to a product dispensing apparatus and gate used to selectively dispense one or more items held inside of the dispensing apparatus.

BACKGROUND OF THE INVENTION

Dispensing containers or packages of all types have existed for many years. Dispensing devices may comprise anything from completely open containers to enclosed containers with movable panels or parts for opening the container. Dispensing containers come in all different sizes and shapes and may serve various purposes.

Products of all different types need to be transported, stored and dispensed depending on the particular environment, in an appropriate manner. Products such as drink containers (e.g., beer cans, soda cans, juice boxes, etc.), toothbrushes, packages of crayons, medical devices (e.g., needles), food products, candy, treats, pens and pencils, golf tees, mints and toothpicks at a restaurant, and many other potential products are examples of products that may require secure transportation, storage and subsequent dispensing.

Product dispensing apparatuses formed, at least in part, from two-dimensional forms are known in the art, e.g., see U.S. Pat. Nos. 4,043,095, 4,155,4494,478,334, 4,508,258, 4,679,725, 4,706,876, 4,728,026, 4,785,991, 4,830,267, 4,811,894, 4,913,291, 5,020,668, 5,878,947 and 6,789,673. However, none of these inventions appear to disclose a slidable or movable gate.

U.S. Pat. Nos. 6,273,332 and 6,435,402 appear to disclose packages with slidable or movable gates formed from two-dimensional unitary forms. However, the gates disclosed in U.S. Pat. Nos. 6,273,332 and 6,435,402 are not configured to separate from the two-dimensional unitary form after first use. Furthermore, it would be advantageous to have a gate including tabs with perforations that allow the gate to separate from the tabs and slide within a channel between the tabs which is not disclosed in U.S. Pat. Nos. 6,273,332 and 6,435,402.

It would be advantageous to have a product dispensing apparatus with a gate formed from a two-dimensional unitary form, wherein the gate is configured for physically separating from the two-dimensional unitary form upon first use. Thus, there exists a need in the art for a product dispensing apparatus, gate and methods for assembling and using same.

BRIEF SUMMARY OF THE INVENTION

Embodiments of the present invention relate to a slidable gate for incorporation into a product dispensing apparatus for all types of products (packaged or bulk goods), e.g., candies, cookies, snacks, treats, drinks, beverage containers, medical or dental products, and other products. More specifically, embodiments of the present invention include a container for selectively dispensing any type of dispensable product by providing one or more movable panels or gates such that each gate can be positioned to access, close or at least partially close an opening or dispensing area in the container. Alternatively, each panel can be positioned to allow user access to the dispensing area where the products are held. In one embodiment, the container may be a Halloween box for dispensing candies. The movable panels may include indicia, such as facial features, themes of any kind (including but not limited to Halloween images), or any other indicia to provide additional allure, excitement, and fun for the persons utilizing the product dispensing apparatus.

An embodiment of a gate for a product dispensing apparatus formed from a two-dimensional unitary form according to the present invention is disclosed. The two-dimensional body may be configured for assembly into the product dispensing apparatus having an interior sized for storing, transporting and dispensing a plurality of products. The two-dimensional unitary form may include a first panel and a gate panel connected to the first panel along a fold line and including a gate. The two-dimensional unitary form may further include two gate-enclosing panels surrounding the gate panel. The gate panel may further include a plurality of tabs connected to the gate along tab perforations, the plurality of tabs configured to be affixed between the two gate-enclosing panels during the assembly.

Another embodiment of a gate for a product dispensing apparatus formed from a two-dimensional unitary form according to the present invention is disclosed. The two-dimensional body may be configured for assembly into the product dispensing apparatus having an interior sized for storing, transporting and dispensing a plurality of products. The two-dimensional body may include a first major flap configured with a first portal and a second major flap configured with a second portal. The two-dimensional body may further include a gate panel connected to the first major flap along a fold line and including a gate surrounded by tabs at tab perforations. The gate panel may be configured for placement between the first and second major flaps, with the first and second major flaps affixed to both sides of the tabs with the first and second portals aligned during assembly of the product dispensing apparatus.

An embodiment of a product dispensing apparatus formed from a two-dimensional unitary form having a plurality of panels according to the present invention is disclosed. The two-dimensional unitary form may be configured for assembly into a container having an interior, wherein the interior is sized for storing, transporting and dispensing a plurality of products. The two-dimensional unitary form may include a top panel and two gate-enclosing panels. The two-dimensional unitary form may further include a gate panel connected to the top panel along a fold line and the gate panel located between the two gate-enclosing panels. The gate panel may further include a gate and tabs configured for initially securing the gate between the two gate-enclosing panels during the assembly. The gate may further be configured for separating from the tabs and sliding between the two gate-enclosing panels during use.

An embodiment of a method of forming a movable gate for a product dispensing apparatus according to the present invention is disclosed. An embodiment of a method of using a movable gate for a product dispensing apparatus according to the present invention is also disclosed.

The foregoing apparatuses, methods and other features, utilities, and advantages of the invention will be apparent from the following detailed description of the invention with reference to the accompanying drawings.

BRIEF DESCRIPTION OF THE DRAWINGS

The following are brief descriptions of the drawings illustrating embodiments of the present invention. Additionally, like reference numerals refer to like parts in different views of the drawings. It should be noted that the elements shown within the drawings may not be shown to scale.

DETAILED DESCRIPTION OF THE INVENTION

Embodiments of a product dispensing apparatus, gate and methods for assembling and using are disclosed. A particularly, useful feature of the embodiments is a movable gate having tabs with perforation which may be formed as part of a unitary body configured for assembly into a product dispensing apparatus. According to an additional feature, the gate may be configured to separate from the tabs upon first use and then be used to open and close or at least partially close a portal for accessing products within the product dispensing apparatus. According to other features, the gate may also be configured to slide up and down, from side-to-side or move within a channel formed in part by the tabs at the perforations and by other gate-enclosing panels.

Figure 1:
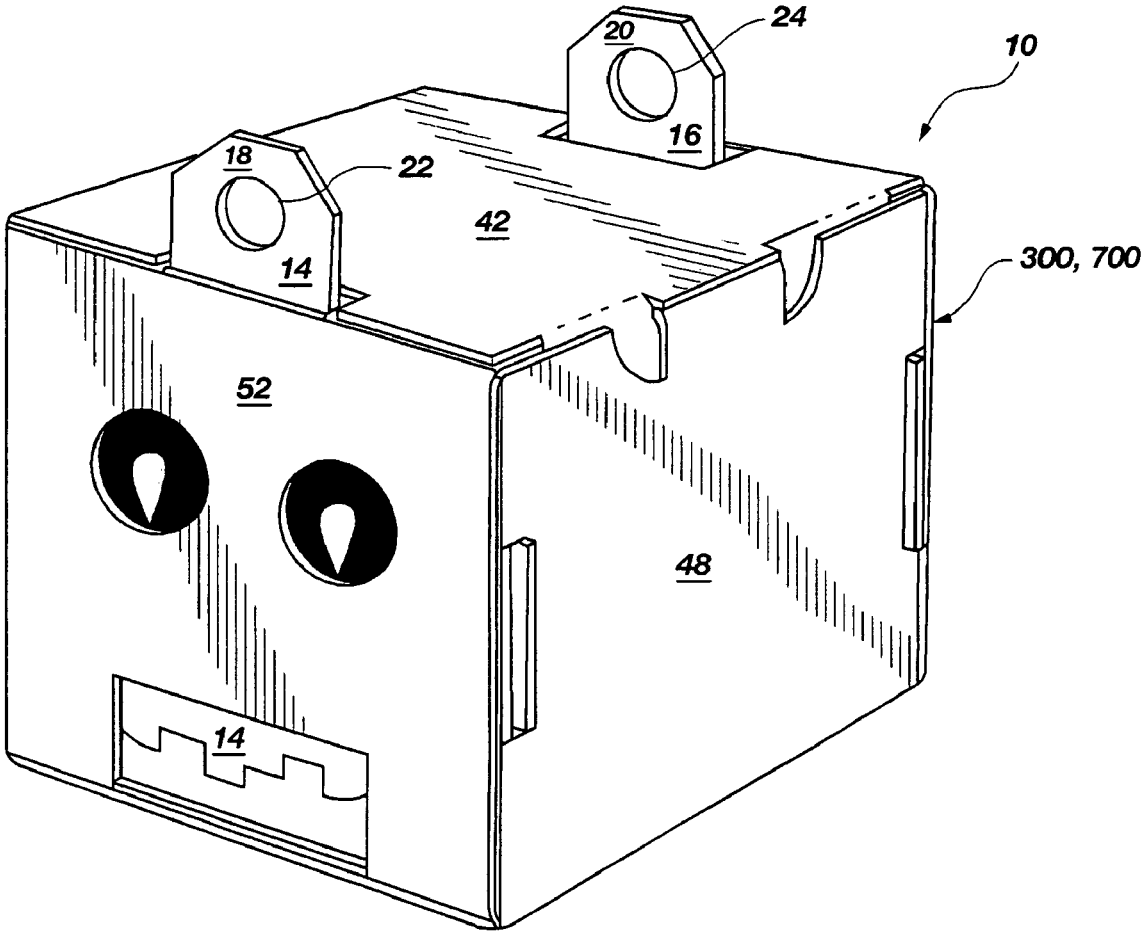
FIG. 1 is a perspective view of one embodiment of a product dispensing apparatus according to the present invention.
Figure 2:
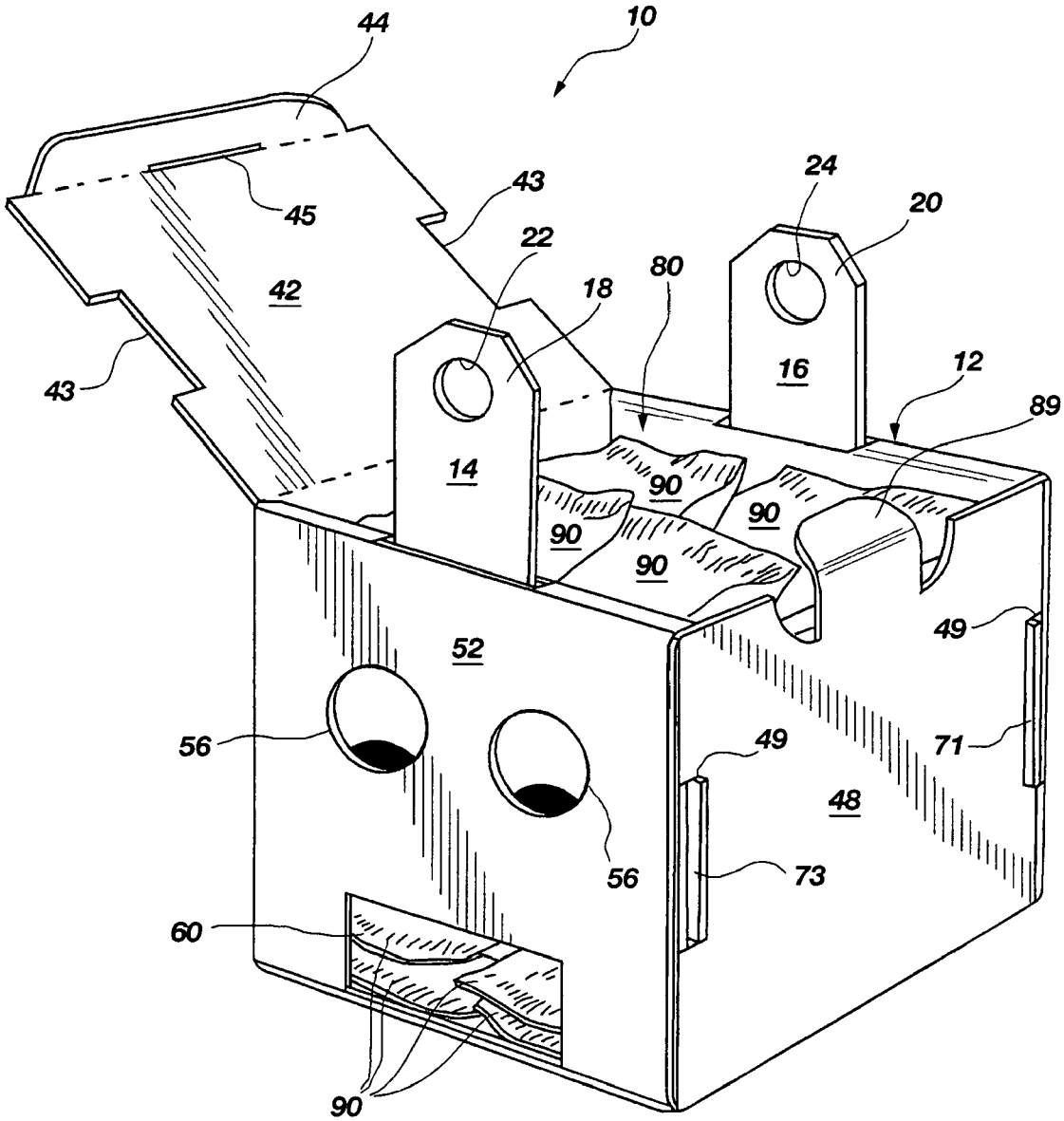
FIG. 2 is a perspective view of the embodiment of the product dispensing apparatus shown in FIG. 1 with the top panel shown in an open position and one of the movable panels shown in an open position to provide access to dispensing area of the interior of the container.

As shown in FIGS. 1-2, an embodiment of the present invention may include a product dispensing apparatus 10 having a main structure in the form of a body or housing 12 comprising solid or stationary panels and one or more slidable, positionable, or otherwise moveable gate panels 14, 16. The various panels may be separate or integral, and may be folded relative to one another to form the product dispensing apparatus 10. Alternatively, it is to be understood that the panels could be individually manufactured and assembled using fasteners, glue, tabs, slots, staples, or other connectors to secure the panels together to form a container. The product dispensing apparatus 10 may thus be made from a single sheet of material with the appropriate cuts and fold lines being created in a sheet of material (see, e.g., FIGS. 3 and 7). In various embodiments of the present invention, the material used to manufacture the product dispensing apparatus 10 may be plastic, paper or cardboard, corrugated or not, although it will be understood by those in the art that other suitable materials may be used without departing from the scope of the present invention. Furthermore, the term "two-dimensional form" (unitary or otherwise) as used herein, reflects on the planar form of the container or packaging. However it should be noted that the two-dimensional forms described and claimed herein will have some depth or thickness, especially when formed of corrugated packaging materials.

The product dispensing apparatus 10 may be used for virtually any suitable type of products. Specifically, the dispensing device may hold or contain for dispensing purposes, without limitation, candies, cookies, snacks, bulk foods, cans of soup, fruits, vegetables, beverage containers, drinks, medical or dental products for use by consumers, or any other types of products that lend themselves to dispensing.

The embodiment of a product dispensing apparatus 10 may include a container defined by a first movable or slidable gate panel 14 and a second movable or slidable gate panel 16. The movable gate panels are incorporated into or slidably attached to the housing 12 to allow up-and-down, sliding movements of the gate panels 14, 16 relative to the other stationary panels of the housing 12. The movable gate panels 14, 16 are held in position and enveloped by specific side panels that are folded to form, in part, the main body or housing 12. The gate panels 14, 16 each include top extension tabs, extension portions or handles 18, 20, respectively. Each handle 18, 20 may include apertures 22, 24, respectively, which may be utilized by the user to move each of the gate panels 14, 16 between open and closed positions. Note that the term "aperture" as used herein may refer to a cut-out hole of any shape, a slot in the panel material or even an area defined by perforations that may be removed to form a hole.

When the product dispensing apparatus 10 is to be closed to prevent dispensing, slidable gate panels 14, 16 may be moved downward to closed positions to block or partially block openings or dispensing locations 58, 60 (discussed below). Handles 18, 20 may be folded down and maintained in a down position by lid 42 (which will secure the container in a closed position). Alternatively, the handles 18, 20 can be left extending above the lid 42 to allow the dispensing locations 58, 60 to be selectively accessed. Because product tampering can be a problem with respect to the distribution of certain products, extension tabs or handles 18, 20 may be secured in a down position (and thereby rendered inaccessible) by lid 42. Further, anti-tampering tape or other product safety mechanisms or anti-tampering systems can be employed to deter product tampering. If anti-tampering tape is used, for example, the gate panels 14, 16 could not be moved or otherwise opened until the product dispensing apparatus 10 has been unsealed (by cutting or removing the tape) and opened for the first time.

Figure 3:
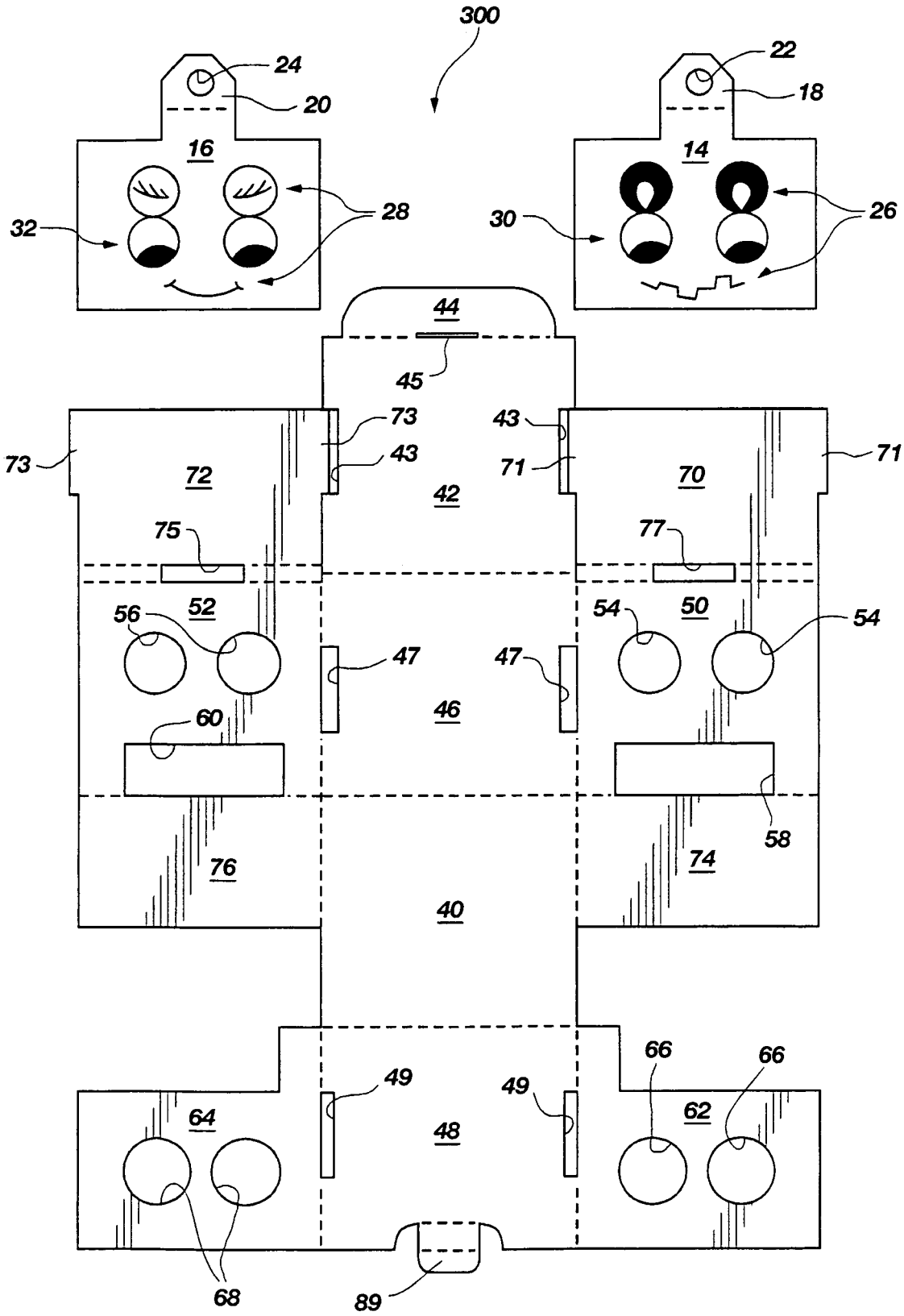
FIG. 3 is a plan view of an embodiment of a two-dimensional body which may be assembled into the product dispensing apparatus illustrated in FIG. 1 including two separated movable gate panels.
Figure 7:
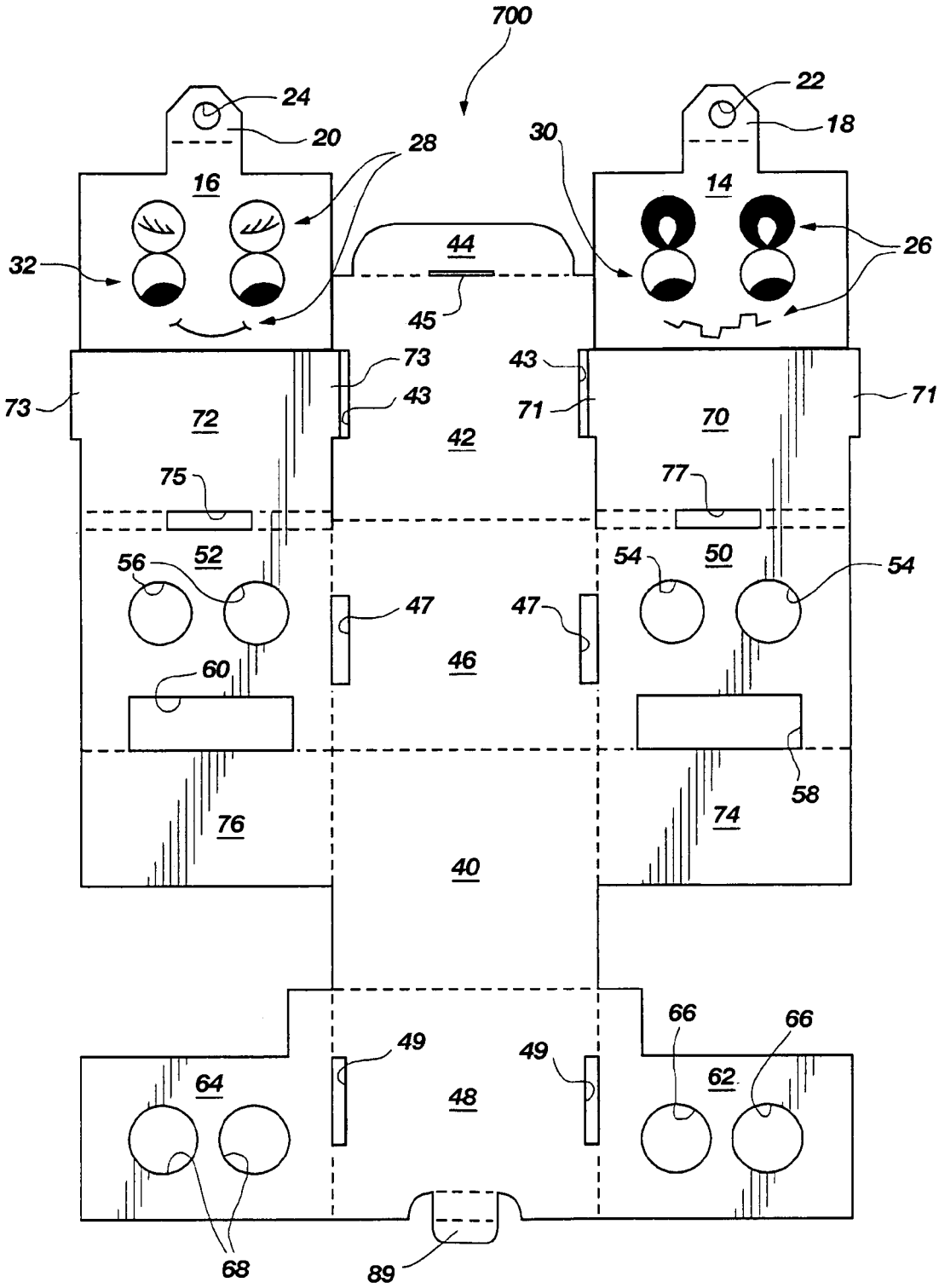
FIG. 7 is a plan view of an embodiment of a unitary two-dimensional body including gate panels initially attached which may be assembled into the product dispensing apparatus of FIG. 3.

The gate panels 14, 16 may further comprise indicia on their respective outside or exterior-facing surfaces such that the indicia will be exposed during use of the product dispensing apparatus 10. Referring additionally to FIGS. 3 and 7, each gate panel 14, 16 may include a first set of indicia 26, 28, and a second set of indicia 30, 32, respectively. When the slidable, movable gate panels 14, 16 are in their closed positions, the first set of indicia 26, 28, respectively, are exposed through circular "eye" or differently configured openings 56 (discussed below) formed in the main portion of the container or housing 12. When the slidable panels 14, 16 are raised to their open positions, indicia 30, 32, respectively, are exposed through the eye or similar openings and access is allowed to the dispensing areas 58, 60 of container formed by the two-dimensional body 300, 700. Access into dispensing areas 58, 60 is provided at the discretion of the user of the product dispensing apparatus 10.

As shown in FIG. 3, and as mentioned above, the product dispensing apparatus 10 may be formed of one or more sheets of cardboard (or any other suitable material) that is cut as shown in FIG. 3 and formed with fold lines (shown as dashed lines in FIG. 3), such that the two-dimensional body 300 may be formed into a container unit with a dispensing ability, with the separate movable gate panels 14, 16 being slidably disposed inside two of the opposite end walls. In this manner, the separate panels 14, 16 are incorporated into the product dispensing apparatus 10.

Panel 40 comprises the bottom wall of product dispensing apparatus 10. Panel or lid 42 comprises the top wall of product dispensing apparatus 10. Lid 42 includes a flap 44 which serves to lock the lid 42 in position. When the lid 42 is in a closed position (with handles 18, 20 in either upright positions or folded-down positions), the flap 44 is inserted on the inside of panel 48. Locking tab 89, integrally extending from panel 48, may be inserted into a slot 45 formed inside of lid 42 to securely hold the lid 42 in a closed position. Slots 43 (FIG. 3) formed in lid 42 allow handles 18, 20 of gate panels 14, 16 to slide up and down relative to lid 42.

Panels 46, 48 are solid panels with no central openings. Panels 46, 48 form upstanding side walls in the box or product dispensing apparatus 10. Although the embodiment of FIGS. 1-3 show that movable gate panels 14, 16 may be placed behind side walls 50, 52, those skilled in the art will understand that movable gate panels may similarly be placed behind other side walls, for example side walls 46, 48 to dispense products according to other embodiments of the present invention without departing from the spirit and scope of the present invention.

Referring still to FIG. 3, side panels 50, 52 may include apertures 54, 56, respectively, which may be configured to show an eye indicia 26, 28, or any other indicia in any desired manner without departing from the scope of the invention. Side panels 50, 52, may further include access apertures or dispensing locations 58, 60, respectively. Panels 46 and 48 may include longitudinal apertures 47 (on panel 46) and longitudinal apertures 49 (on panel 48) to receive locking tabs 71 (formed on panel 70) and locking tabs 73 (formed on panel 72). Locking tabs 71, 73 may further serve to hold the folded product dispensing apparatus 10 together as a whole in a solid, rigid container configuration. Partial panels 62, 64 are formed adjacent side wall panel 48 and include their own respective openings 66, 68, which, when the entire box or container is folded, correspond with apertures 54, 56, respectively. Partial panels 62, 64 provide additional side support for the product dispensing apparatus 10.

Fold-down panels 70, 72 are provided to fold down around movable gate panels 14, 16, respectively. These fold-down panels 70, 72, further serve to reinforce the housing 12 of product dispensing apparatus 10 to provide protection for the products held inside the product dispensing apparatus 10. Panels 70, 72 also include top slots 75, 77, which allow extensions or handles 18, 20 of gate panels 14, 16 to slide up and down relative to the other portions of the product dispensing apparatus 10. Still further, bottom wall panels 74, 76 are further provided to reinforce the bottom surface of the housing 12 of product dispensing apparatus 10.

When assembling the two-dimensional body 300, 700 to form the product dispensing apparatus 10, the two-dimensional body 300, 700 may be manufactured from one or more pieces of cardboard (corrugated or card stock), plastic, or other suitable material. The dispensing apparatus 10 may be formed using several different pieces without departing from the scope of the present invention. For example, and not by way of limitation, FIG. 3 illustrates a two-dimensional body 300 formed from three separate panels, two of which are gate panels 14, 16. Still further, although movable gate panels 14, 16 are shown as separate panels, these panels could also be incorporated into a unitary two-dimensional body such that the entire product dispensing apparatus 10 could be manufactured from a single piece of material. See, for example, FIG. 7, which illustrates a plan view of an embodiment of the product dispensing apparatus of FIG. 3, in a flat, unfolded position showing a unitary two-dimensional body 700 with the two movable gate panels 14, 16 of FIG. 3 initially integrated with the unitary two-dimensional body 700 prior to separation and assembly as a product dispensing apparatus 10.

Referring to FIG. 7, after the movable gate panels 14, 16 are separated from the unitary two-dimensional body 700, the housing 12 may be assembled by folding along the dotted lines (shown in FIG. 3) with the movable gate panels 14, 16 positioned between panels 50 and 70 (on the one side) and 52, 72 (on the other side). The resulting product dispensing apparatus 10 appears as shown in FIG. 2. With the top panel or lid 42 in an open position, the interior compartment 80 of the housing 12 may be filled with one of any number of different types of treats 90 or other suitable dispensed product.

For example, without limitation, the product to be dispensed from product dispensing apparatus 10 may be candies, cookies, or any other type of treat or other product. It should be understood that various other types of products may be dispensed utilizing the product dispensing apparatus 10 according to the present invention. For example, again without limitation, the product dispensing apparatus could be used to dispense beverage-containing cans (i.e., a multi-pack of beer or soda) for placement in the refrigerator. When the user of product dispensing apparatus 10 wants to access a product or beverage container, one of the movable gate panels 14, 16 may be raised to access the interior of the product dispensing apparatus 10. Thereafter, the movable panel 14, 16 can be moved into a closed or partially closed position to prevent other cans from rolling out of the product dispensing apparatus 10.

Other possible examples where a product dispensing apparatus 10 according to the present invention may be useful include, still again without limitation, any size or type of can that forms a multi-pack case, any round or oval shaped package, toothbrushes, crayons (e.g., crayons passed out at a restaurant), medical products (e.g., packaged needles distributed at a needle exchange), packaged dog treats for distribution at a veterinarian's office, wrapped treats for in-home use, treats and rewards for distributing at school, pens and pencils for distributing to students at school, packages of golf tees (or golf tees in bulk), mints and toothpicks at a restaurant, etc.

After products have been introduced into the interior compartment of housing 12, the top panel or lid 42 may be closed and retaining flap 44 is folded down and locking tab 89 is slid into an aperture 45 formed in top panel or lid 42 to hold the entire product dispensing apparatus 10 together. The movable gate panels 14, 16 may alternatively be placed into open positions (an open position is shown with respect to gate panel 14 in FIG. 2) or, alternatively, closed positions (a closed position is shown with respect to gate panel 14 in FIG. 1).

In a Halloween context, for example, when a person answers the door to handle a trick-or-treat call during Halloween, the display box can be shown as set forth in FIG. 1 with the panel 14 in a closed position. Upon answering to the Halloween "trick-or-treat" challenge, the panel 14 can be raised so that the interior contents or treats 90 (FIG. 2) can be accessed by the trick-or-treater. The indicia which comprise portions of faces will look different depending on the position of the panels 14, 16. Additionally, the gate panels 14 and 16 can have a non-seasonal look and made with or without indicia for other requests for self-dispensed products.

Figure 4:
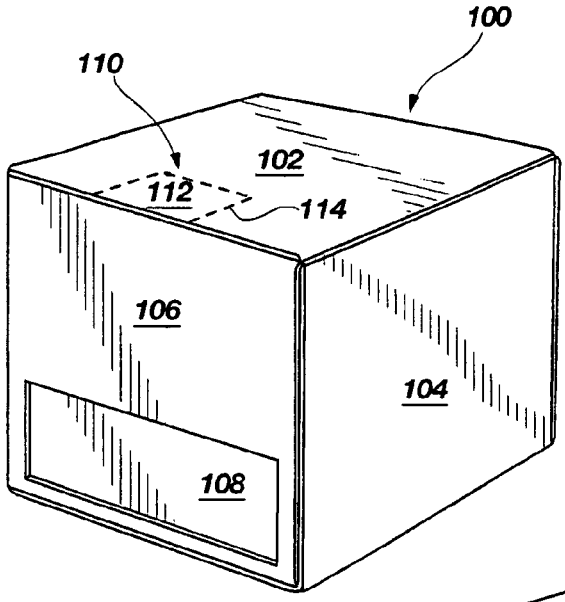
FIG. 4 is an upper-right perspective view of an alternative embodiment of a product dispensing apparatus according to the present invention.
Figure 5:
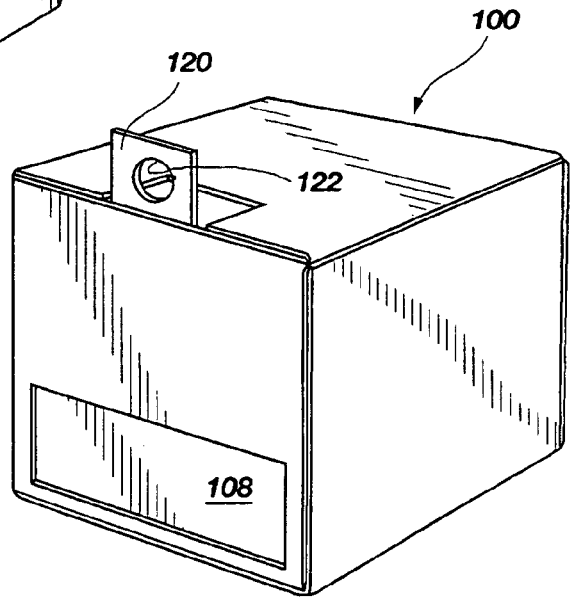
FIG. 5 is an upper-right perspective view of the embodiment of the product dispensing apparatus of FIG. 4 showing a safety tab removed and handle of a movable gate panel shown in a closed position.
Figure 6:
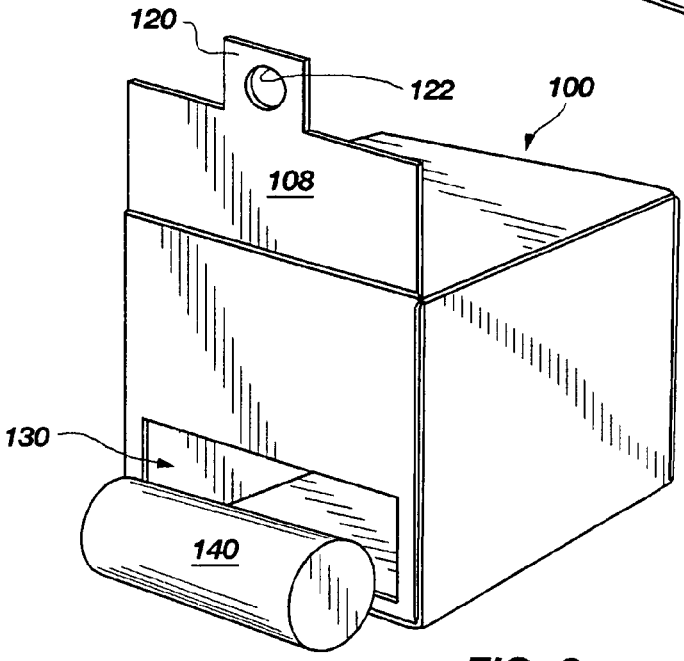
FIG. 6 is an upper-right perspective view of the embodiment of the product dispensing apparatus of FIG. 4 with the gate shown in a raised position to allow access to the dispensing area of the interior of the product dispensing apparatus, specifically for dispensing beverage containers.

An alternative embodiment of the present invention is shown in FIGS. 4-6. It is to be understood that the manufacture and assembly of the embodiment of FIGS. 4-6 may be substantially similar to the embodiment shown in FIGS. 1-3. A product dispensing apparatus 100 may include a top panel 102, side panels 104 (only one shown), a front panel 106, and a movable gate panel 108. The rear panel and bottom panels are not shown, but are substantially the same as the rear and bottom panels shown in connection with the embodiment of FIGS. 1-3.

One embodiment of an anti-tampering system 110 is shown with respect to the apparatus 100 of FIG. 4. The anti-tampering apparatus 110 more specifically includes a removable section 112 of the apparatus 100. The removable section or panel 112 includes perforations 114 (FIG. 4) to facilitate its removal from the product dispensing apparatus 100. The purchaser of the product dispensing apparatus 100 can have confidence that the contents held inside of the product dispensing apparatus 100 have not been tampered with if the removable section or panel 112 remains in position with the perforations 114 remaining intact. The anti-tampering system 110 illustrated may provide the same functionality as anti-tampering seals placed around bottles and the like which, if broken, suggest package tampering.

After the removable section 112 of top panel 102 is removed, an extension tab or handle 120 can be raised so that an aperture 122 in the extension 120 is exposed and a user can insert his or her finger into aperture 122 to raise and lower the panel 108. FIG. 5 shows the panel 108 in a closed position. FIG. 6 shows panel 108 in a raised position so that access into the interior or dispensing area 130 of the product dispensing apparatus 100 can be achieved. In the embodiment of FIGS. 4-6, a plurality of beverage containers 140 (only one shown) can be held inside the dispensing apparatus 100. Thus, the dispensing apparatus 100 may function as a 12-pack container, a 24-pack container, or a container holding any reasonable number of cylindrical or mostly cylindrical containers 140 depending on the particular application. Those skilled in the art will understand that any given number of products, and any particular types or configurations of products, may be utilized without departing from the scope and spirit of the present invention. After the desired product 140 is removed from the inside 130 of dispensing apparatus 100, the panel 108 can be moved to a closed (or partially closed) position, as shown in FIG. 5, for future dispensing on an as-needed basis.

An embodiment of a gate for a product dispensing apparatus formed from a two-dimensional unitary form configured for assembly into the product dispensing apparatus is disclosed. The product dispensing apparatus may include an interior sized for storing, transporting and dispensing a plurality of products. The two-dimensional unitary form may include a first panel and a gate panel connected to the first panel along a fold line. The two-dimensional unitary form may further include two gate-enclosing panels surrounding the gate panel. The gate panel may include a gate and a plurality of tabs connected to the gate along tab perforations the plurality of tabs configured to be affixed between the two gate-enclosing panels during the assembly. The plurality of tabs may be configured for placement between the two gate-enclosing panels during assembly of the product dispensing apparatus.

According to another embodiment of the present invention, the gate may further include a handle extending into the first panel and defined by first panel perforations configured for separating the handle of the gate from the first panel during a first use. The handle may further include a mechanism for inserting a finger to grasp the handle according to embodiments of the present invention. For example and not by way of limitation, the mechanism may include one of the following embodiments: an opening, perforations outlining an area configured to form an opening when the area is removed, perforations configured to allow insertion of the finger when broken, or a slit configured to allow insertion of the finger therethrough.

According to yet another embodiment, the gate of the gate panel may be configured for separating from the plurality of tabs along the tab perforations upon first use by pulling the handle. The gate may further be configured to slide either direction between an open position and a closed position while disposed in sliding contact between the two gate-enclosing panels after a first use to provide access to and storage of the plurality of products, according to another embodiment of the gate.

Another embodiment of a gate for a product dispensing apparatus formed from a two-dimensional unitary form is disclosed. The two-dimensional unitary form may be configured for assembly into the product dispensing apparatus having an interior sized for storing, transporting and dispensing a plurality of products. The two-dimensional unitary form may include a first major flap configured with a first portal and a second major flap configured with a second portal. The two-dimensional unitary form may further include a gate panel connected to the first major flap along a fold line and including a gate surrounded by tabs at tab perforations. The gate panel may be configured for placement between the first and second major flaps. The first and second major flaps may be affixed to both sides of the tabs with the first and second portals aligned during assembly of the product dispensing apparatus. When the gate is in a closed position, it rests between the first and second major flaps and covers all or part of the aligned first and second portals or a perforated area that may be removed to become a portal. When the gate is in an open position, it rests between the first and second major flaps and exposes the aligned first and second portals. The gate may further include a handle for grasping the gate according to an embodiment of the present invention.

An embodiment of a product dispensing apparatus formed from a two-dimensional unitary form having a plurality of panels and configured for assembly into a container is disclosed. The container of the product dispensing apparatus has an interior sized for storing, transporting and dispensing a plurality of products. The two-dimensional unitary form may include a top panel and two gate-enclosing panels. The two-dimensional unitary form may further include a gate panel connected to the top panel along a fold line, the gate panel located between the two gate-enclosing panels. The gate panel may further include a gate and tabs configured for initially securing the gate between the two gate-enclosing panels during assembly of the product dispensing apparatus. The gate may further be configured for separating from the tabs and sliding between the two gate-enclosing panels during use.

According to an embodiment of the product dispensing apparatus, the gate panel may further include perforations between the tabs and the gate. The perforations may include micro-perforations according to an embodiment of the product dispensing apparatus. According to another embodiment of the product dispensing apparatus, the perforations may comprise slots separated by narrow bridges. According to another embodiment of the product dispensing apparatus, the gate may further include a handle formed into the top panel, outlined in part by perforations in the top panel. According to yet another embodiment of the product dispensing apparatus, the gate may further include a mechanism for inserting a finger to grasp the handle during use and for separating the handle from the top panel along the perforations. The mechanism may take any one of a number of embodiments, for example and not by way of limitation, an opening, perforations outlining an area configured to form an opening when the area is removed, a slit configured to allow insertion of a finger therethrough, or perforations configured to allow insertion of a finger when the perforations are broken.

According to another embodiment of the product dispensing apparatus, the two-dimensional unitary form may further include a second gate panel including tabs and two other gate-enclosing panels formed in the two-dimensional unitary form configured for securing the second gate panel in an initial configuration between the two other gate-enclosing panels during assembly of the product dispensing apparatus. According to other embodiments of the product dispensing apparatus, the two gate-enclosing panels (and the two other gate enclosing panels) are each configured with aligned portals sized for dispensing the products when the gate is in an open configuration. The aligned portals may initially comprise aligned areas or doors traced by perforations in the two gate-enclosing panels (and the two other gate-enclosing panels) and may include aligned openings upon removal of the aligned areas or doors. According to another embodiment, the aligned portals may include cutouts in the two gate-enclosing panels. In still another embodiment, each of the plurality of products comprises a product or a product in a container.

Figure 8:
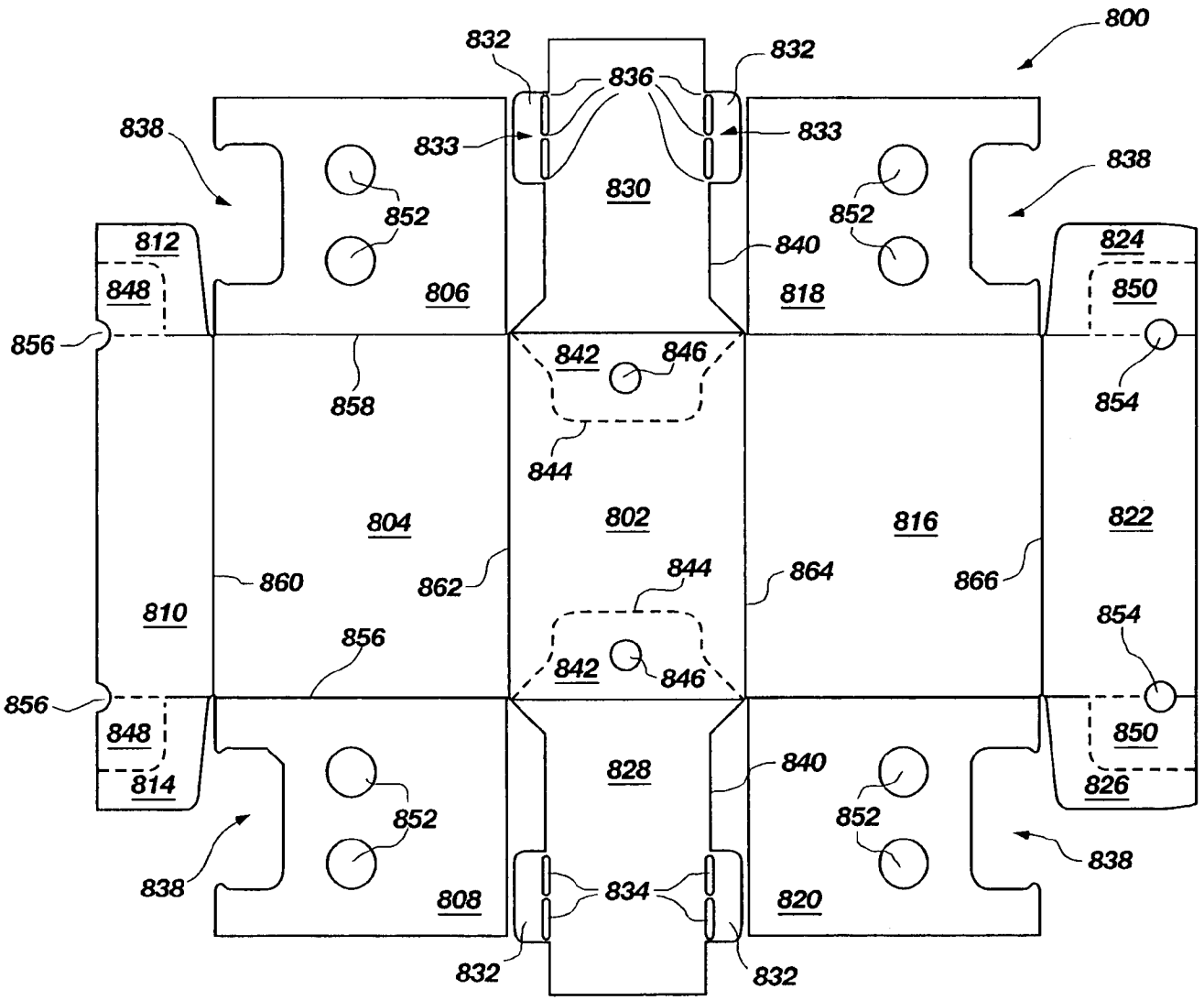
FIG. 8 is a plan view of still another embodiment of a two-dimensional unitary form configured for assembly into a product dispensing apparatus according to the present invention.

FIG. 8 is a plan view of an embodiment of a two-dimensional unitary form 800 configured for assembly into a three-dimensional product dispensing apparatus according to the present invention. Body 800 may be formed of any suitable cardboard or other paper or plastic material, corrugated or otherwise. Body 800 may include a top panel 802, a left side panel 804, a left rear panel 806, a left front panel 808, a left bottom panel 810, a left rear flap 812, a left front flap 814, a right side panel 816, a right rear panel 818, a right front panel 820, a right bottom panel 822, a right rear flap 824 and a right front flap 826. Body 800 may also include front gate panel 828. Body 800 may optionally include a rear gate panel 830. Body 800 may also have a first fold line 856, a second fold line 858, a third fold line 860, a fourth fold line 862, a fifth fold line 864 and a sixth fold line 866. Assembly of the product dispensing apparatus from the body 800 is facilitated by folding down along all fold lines 856, 858, 860, 862, 864, and 866. Although body 800 has been referenced according to panels having identifiers, i.e., top, bottom, left, right, etc., that might suggest only one particular configuration of the product dispensing apparatus formed thereof, the identifiers are merely used for reference and not intended to be limiting in any way. It will, of course, be readily apparent to one of ordinary skill in the art that the panels can be referenced in many other ways and that the product dispensing apparatus, once assembled, can be oriented in any suitable direction.

Gate panels 828, 830 may further include a plurality of tabs 832. Tabs 832 may be attached to the gate panels 828, 830 by perforations 833 in the body 800 material. Perforations 833 may be slots 834 separated by narrow bridges 836 as shown in FIG. 8. Alternatively, the perforations 833 may be appropriately sized cuts in the material from which the body 800 is formed. The tabs 832 may be of any suitable size such that they can be attached to panels 806, 808, 818, 820. For example, the tabs 832 shown in FIG. 8 may be extend longer or shortened relative to the size shown according to other embodiments of the present invention.

Gate panels 828, 830 may each include a gate 840 that is configured to separate from tabs 832 along the perforations 833. Gate 840 may further include a handle 842 that may extend into top panel 802. Handle 842 may be configured to separate from top panel 802 along perforations 844 (shown in dotted line). Alternatively, handle 842 may simply be cut from top panel 802 along the dotted line shown at perforations 844 in FIG. 8. Handle 842 may further include a mechanism 846 for grasping handle 842. According to an embodiment of body 800, mechanism 846 may be an opening such as the circular cut-out shown in FIG. 8. According to another embodiment of body 800, mechanism 846 may be perforations outlining an area configured to form an opening when the area is removed. According to yet another embodiment of body 800, mechanism 846 may be perforations configured to allow insertion of a finger when broken. According to still another embodiment of body 800, mechanism 846 may be a slit configured to allow insertion of a finger therethrough.

Panels 806, 808, 818, 820 may include portals 836. Portals 836 may be cutouts as shown in FIG. 8. According to another embodiment of body 800, portal 836 may be a perforated area configured to be removed by separating the area from the body 800 along the perforations, similar to the areas 848, 850, as included on flaps 812, 814, 824, 826. Panels 806, 808, 818, 820 may further include apertures 852 for displaying selected indicia according to another embodiment of the present invention and as described elsewhere in this detailed description. Bottom panels 810 and 822 and flaps 812, 814, 824, 826 may further have apertures 854 or semi-circular cutouts 856, which when the body 800 is assembled may provide a user with a mechanism for grasping and removing areas 848, 850. The particular configuration of apertures 854 or semi-circular cutouts 856 may be similar to the variations of mechanism 846 as described above, according to further embodiments of the present invention.

Figure 9:
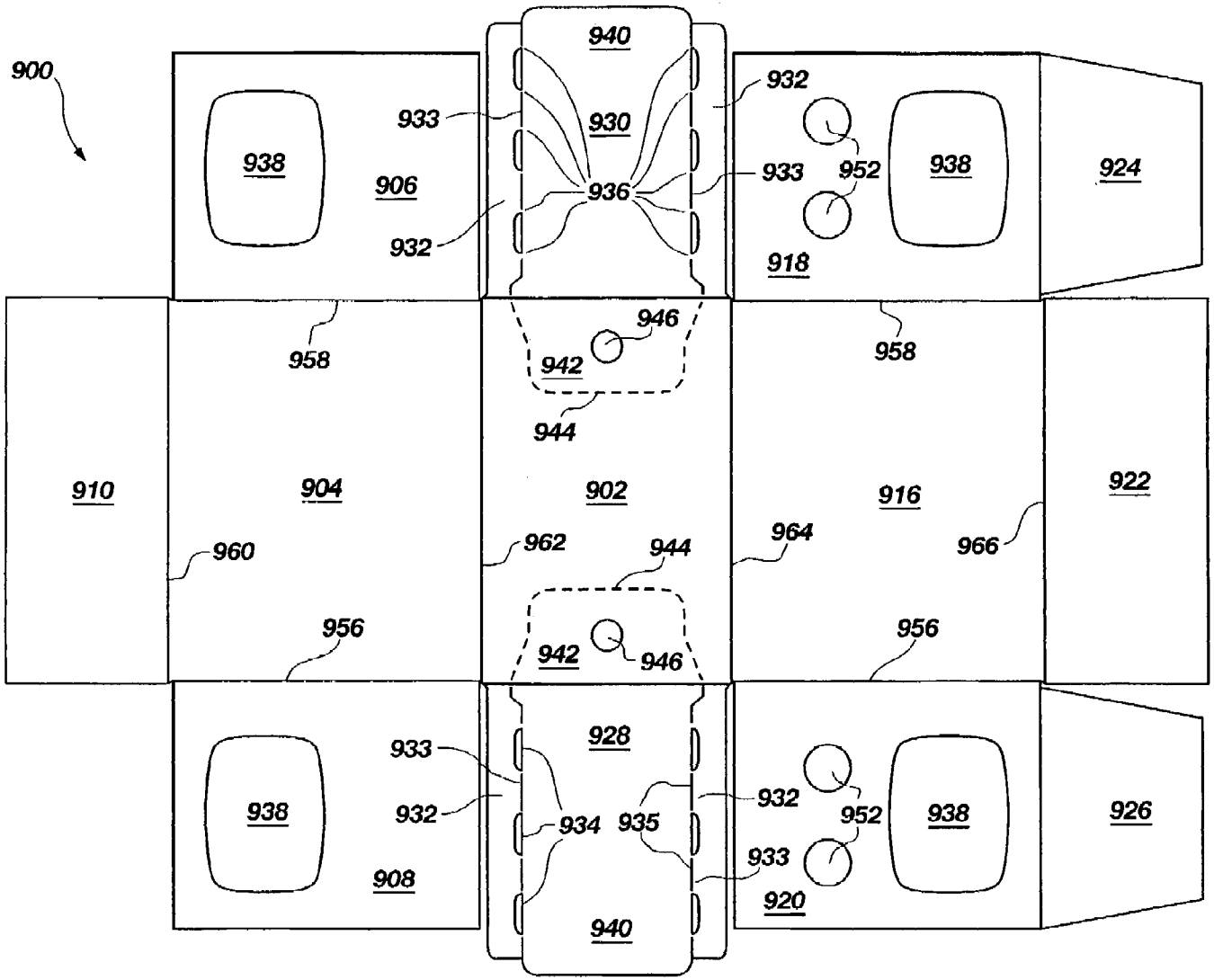
FIG. 9 is a plan view of yet another embodiment of a two-dimensional unitary form configured for assembly into an embodiment of a product dispensing apparatus such as the one illustrated in FIG. 10, according to the present invention.

FIG. 9 is a plan view of an embodiment of a two-dimensional unitary form 900 configured for assembly into an embodiment of a product dispensing apparatus 1000 (see FIG. 10) according to the present invention. Body 900 may be formed of any suitable cardboard or other paper or plastic material, corrugated or otherwise. Body 900 may include a top panel 902, a left side panel 904, a left rear panel 906, a left front panel 908, a left bottom panel 910, a right side panel 916, a right rear panel 918, a right front panel 920, a right bottom panel 922, a right rear flap 924 and a right front flap 926. Body 900 may also include front gate panel 928. Body 900 may optionally include a rear gate panel 930. Body 900 may also have a first fold line 956, a second fold line 958, a third fold line 960, a fourth fold line 962, a fifth fold line 964 and a sixth fold line 966. Assembly of the product dispensing apparatus 1000 from the body 900 is facilitated by folding down along all fold lines 956, 958, 960, 962, 964, and 966. Although body 900 has been referenced according to panels having identifiers, i.e., top, bottom, left, right, etc., that might suggest only one particular configuration of the product dispensing apparatus formed thereof, the identifiers are merely used for reference and not intended to be limiting in any way. It will, of course, be readily apparent to one of ordinary skill in the art that the panels can be referenced in many other ways and that the product dispensing apparatus 1000, once assembled, can be oriented in any suitable direction.

Gate panels 928, 930 may further include a plurality of tabs 932. Tabs 932 may be attached to the gate panels 928, 930 by perforations 933 in the body 900 material. Perforations 933 may be slots 934 separated by slits 935 and narrow bridges 936 as shown in FIG. 9. Alternatively, the perforations 933 may be appropriately sized cuts or slits in the material from which the body 900 is formed. The tabs 932 may be of any suitable size such that they can be attached to panels 906, 908, 918, 920. For example, the tabs 932 shown in FIG. 9 are longer than the tabs 832 shown in FIG. 8, and may be shortened relative to the size shown in FIG. 9 according to other embodiments of the present invention.

Gate panels 928, 930 may each include a gate 940 that is configured to separate from tabs 932 along the perforations 933. Gate 940 may further include a handle 942 that may extend into top panel 902. Handle 942 may be configured to separate from top panel 902 along perforations 944 (shown in dotted line). Alternatively, handle 942 may simply be cut from top panel 902 along the dotted line shown at perforations 944 in FIG. 9. Of course, the particular pattern formed by perforations 944 is not critical to the functioning of handle 942. Handle 942 may further include a mechanism 946 for grasping handle 942. According to an embodiment of body 900, mechanism 946 may be an opening such as the circular cut-out shown in FIG. 9. According to another embodiment of body 900, mechanism 946 may be perforations outlining an area configured to form an opening when the area is removed. According to yet another embodiment of body 900, mechanism 946 may be perforations configured to allow insertion of a finger when broken. According to still another embodiment of body 900, mechanism 946 may be a slit configured to allow insertion of a finger therethrough.

Panels 906, 908, 918, 920 may include portals 936. Portals 936 may be cutout windows as shown in FIG. 9. According to another embodiment of body 900, portal 936 may be a perforated area configured to be removed by separating the area from the body 900 along the perforations. Panels 906, 908, 918, 920 may further include apertures 952 for displaying selected indicia according to another embodiment of the present invention and as described elsewhere in this detailed description. While only panels 918 and 920 are shown having apertures 952, the apertures would only be necessary on the outermost panel. So, panels 906 and 908 could be the outermost panel, depending on order of assembly, according to further embodiments of the present invention.

Figure 10:
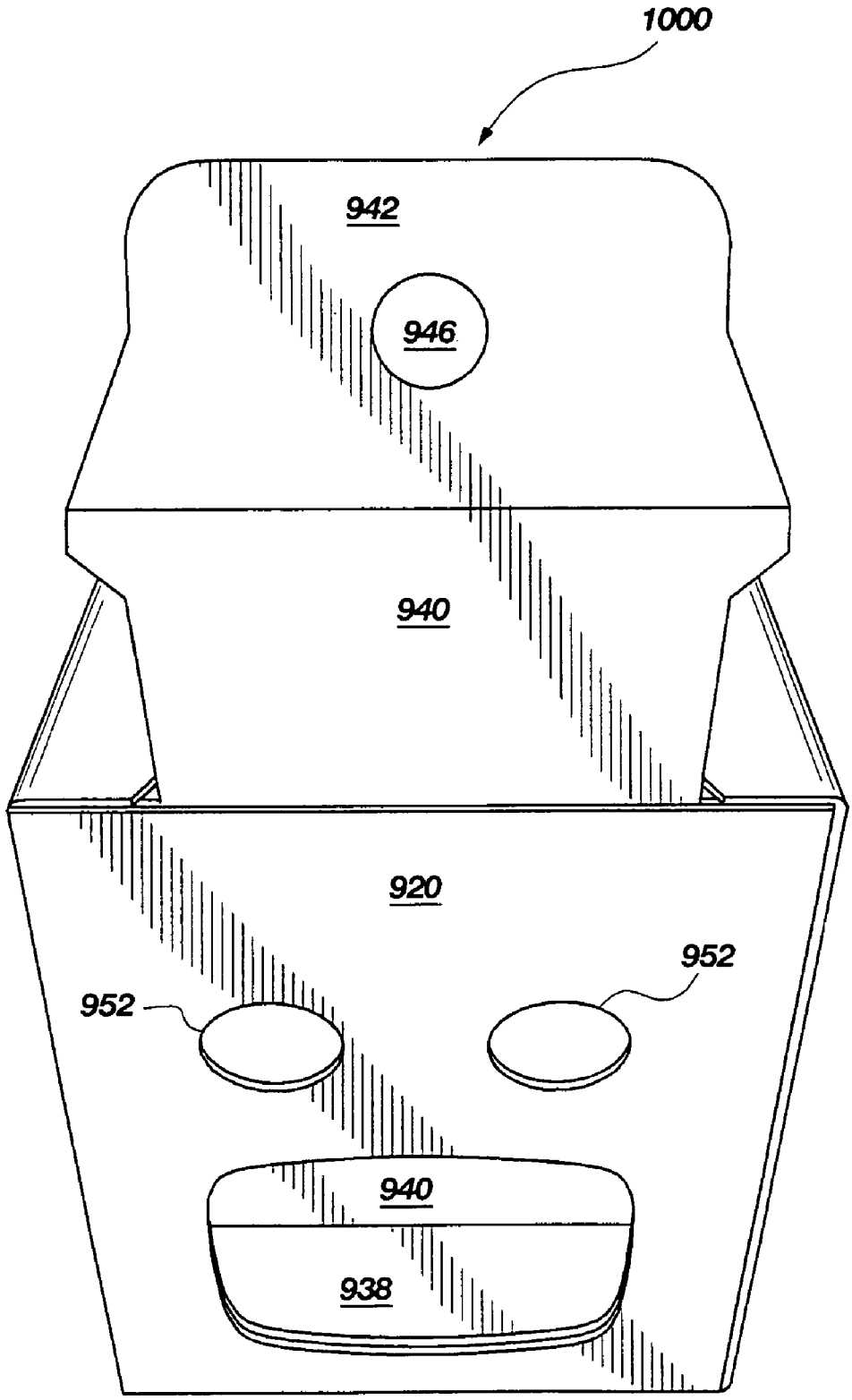
FIG. 10 is a front perspective view of an embodiment a product dispensing apparatus, according to the present invention, assembled from the two-dimensional unitary form illustrated in FIG. 9.

FIG. 10 is a front perspective view of an embodiment a product dispensing apparatus 1000, according to the present invention, assembled from the two-dimensional unitary form 900 illustrated in FIG. 9. The embodiment of a product dispensing apparatus 1000 shown in FIG. 10 shows handle 942 on gate 940 configured for sliding behind right front panel 920 and in front of left front panel 908 (not shown, or vice versa depending on order of assembly) having apertures 952 and portal 938. Mechanism 946 may be cutout or perforated to further assist the user in grasping and manipulating handle 942. By grasping handle 942 the user can pull up thereby exposing the contents within the interior of product dispensing apparatus 1000 through portal 938. Conversely, the user can grasp handle 942 and push the gate 940 down to cover portal 938. Product dispensing apparatus 1000 may be suitable for any sort of product that may be stored, transported and dispensed by opening gate 940 to expose portal 936.

Figure 11:
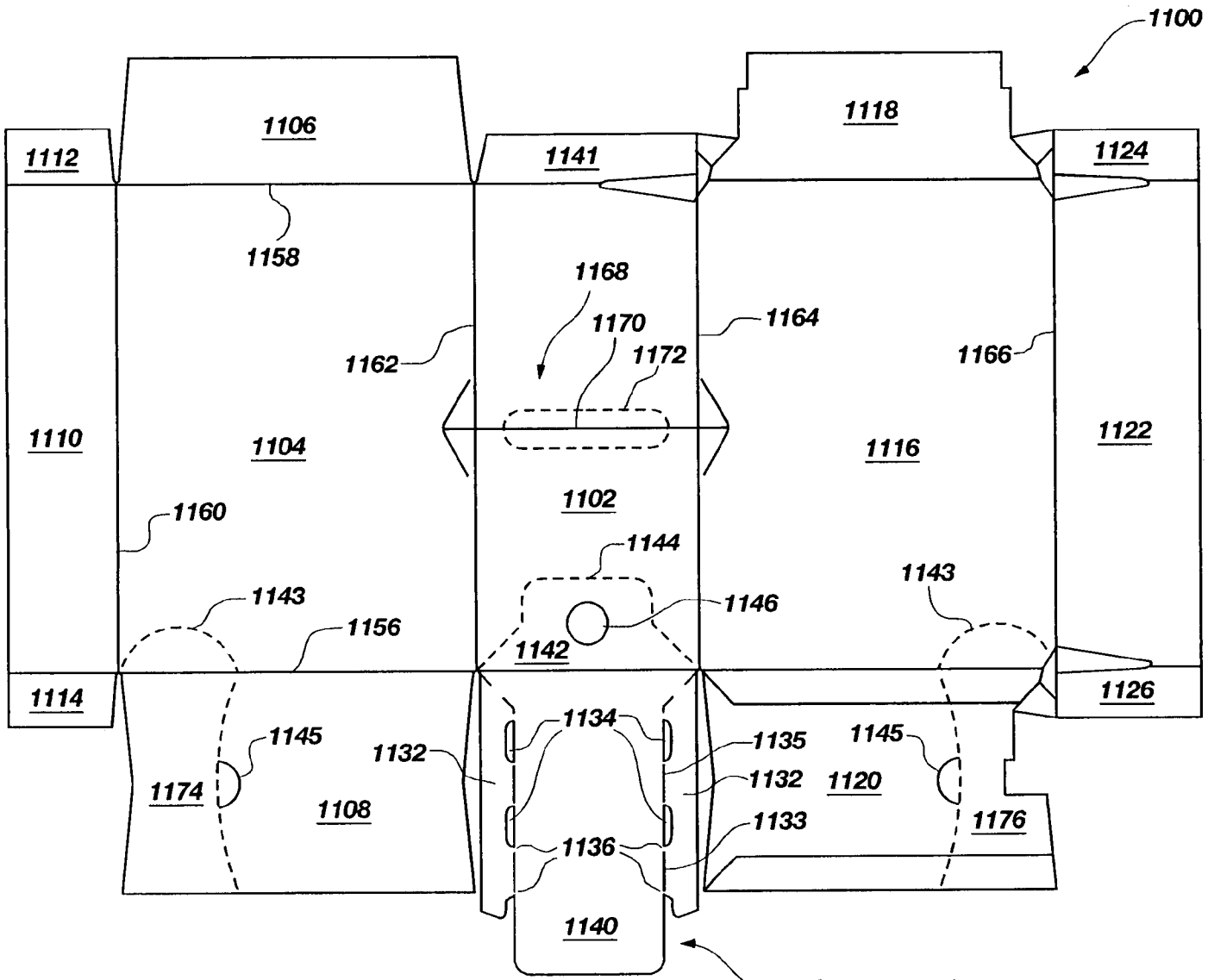
FIG. 11 is a plan view of still yet another embodiment of a two-dimensional unitary form configured for assembly into an embodiment of a product dispensing apparatus such as the one illustrated in FIG. 12, according to the present invention.

FIG. 11 is a plan view of an embodiment of a two-dimensional unitary form 1100 configured for assembly into an embodiment of a product dispensing apparatus 1200 (see FIG. 12) according to the present invention. Body 1100 may be formed of any suitable cardboard or other paper or plastic material, corrugated or otherwise. Body 1100 may include a top panel 1102, a left side panel 1104, a left rear panel 1106, a left front panel 1108, a left bottom panel 1110, a left rear flap 1112, a left front flap 1114, a rear center flap 1141, a right side panel 1116, a right rear panel 1118, a right front panel 1120, a right bottom panel 1122, a right rear flap 1124 and a right front flap 1126. Body 1100 may also include gate panel, shown generally at 1128. Body 1100 may optionally include a rear gate panel (not shown in FIG. 11). Body 1100 may also have a first fold line 1156, a second fold line 1158, a third fold line 1160, a fourth fold line 1162, a fifth fold line 1164 and a sixth fold line 1166. Assembly of the product dispensing apparatus 1200 from the body 1100 is facilitated by folding down along all fold lines 1156, 1158, 1160, 1162, 1164, and 1166. Although body 1100 has been referenced according to panels having identifiers, i.e., top, bottom, left, right, etc., that might suggest only one particular configuration of the product dispensing apparatus formed thereof, the identifiers are merely used for reference and not intended to be limiting in any way. It will, of course, be readily apparent to one of ordinary skill in the art that the panels can be referenced in many other ways and that the product dispensing apparatus 1200, once assembled, can be oriented in any suitable direction.

Gate panel 1128 may further include a plurality of tabs 1132. Tabs 1132 may be attached to the gate panel 1128 by perforations 1133 in the body 1100 material. Perforations 1133 may be slots 1134 separated by slits 1135 and narrow bridges 1136 as shown in FIG. 11. Alternatively, the perforations 1133 may be appropriately sized cuts or slits in the material from which the body 1100 is formed. The tabs 1132 may be of any suitable size such that they can be attached to panels 1106, 1108, 1118 and 1120.

Gate panel 1128 may include a gate 1140 that is configured to separate from tabs 1132 along the perforations 1133. Gate 1140 may further include a handle 1142 that may extend into top panel 1102. Handle 1142 may be configured to separate from top panel 1102 along perforations 1144 (shown in dotted line). Alternatively, handle 1142 may simply be cut from top panel 1102 along the dotted line shown at perforations 1144 in FIG. 11. Of course, the particular pattern formed by perforations 1144 is not critical to the functioning of handle 1142. Handle 1142 may further include a mechanism 1146 for grasping handle 1142. According to an embodiment of body 1100, mechanism 1146 may be an opening such as the circular cut-out area as shown in FIG. 11. According to another embodiment of body 1100, mechanism 1146 may be perforations outlining an area configured to form an opening when the area is removed. According to yet another embodiment of body 1100, mechanism 1146 may be perforations configured to allow insertion of a finger when broken. According to still another embodiment of body 1100, mechanism 1146 may be a slit configured to allow insertion of a finger therethrough.

Left front panel 1108 may include portal 1174. Similarly, right front panel 1120 may include a corresponding portal 1176. Portals 1174 and 1176 may be areas surrounded at least partially by perforations 1143 that may extend into left and right side panels 1104 and 1116 as shown in FIG. 11. The portals 1174 and 1176 may be configured to be removed by separating the areas from the body 1100 along the perforations. Portals 1174 and 1176 may further include finger holes 1145 for assisting a user in grasping and removing portals 1174 and 1176. Panels 1108, 1120 may further include apertures (not shown) for displaying selected indicia according to another embodiment of the present invention and as described elsewhere in this detailed description. According to another feature of the present invention, top panel 1102 may include a handle 1168 for facilitating transportation of product dispensing apparatus 1200 once assembled and even stocked with products for dispensing. Handle 1168 may include slits 1170 and perforations 1172 configured to allow insertion of one or more fingers underneath top panel 1102 for carrying the product dispensing apparatus 1200.

Figure 12:
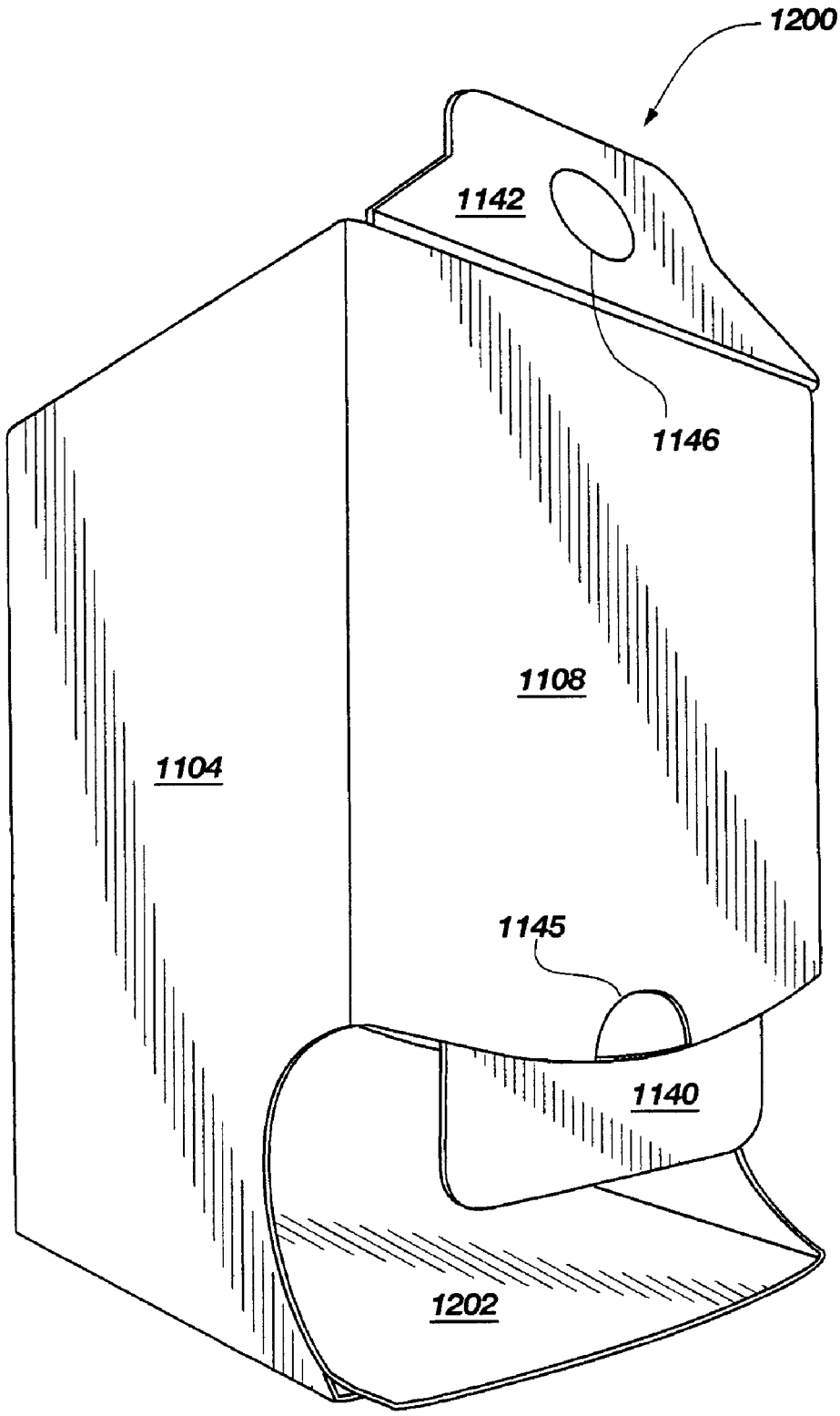
FIG. 12 is a left front perspective view of an embodiment a product dispensing apparatus, according to the present invention, assembled from the two-dimensional unitary form illustrated in FIG. 11.

FIG. 12 is a left front perspective view of an embodiment a product dispensing apparatus 1200, according to the present invention, assembled from the two-dimensional unitary form 1100 illustrated in FIG. 11. The embodiment of a product dispensing apparatus 1200 shown in FIG. 12 shows handle 1142 on gate 1140 configured for sliding behind left front panel 1108 and in front of right 1120 front panel 980 (not shown, or vice versa depending on order of assembly or whether mirror embodiment of two-dimensional unitary form 1100) having an interior 1202 behind portals 1174, 1176 (shown removed in FIG. 12). Mechanism 1146 and finger hole 1145 may be cutout or perforated to further assist the user in grasping and manipulating handle 1142 and portals 1174, 1176. By grasping handle 1142 the user can pull up thereby exposing the contents within the interior 1202 of product dispensing apparatus 1200 through portals 1174, 1176. Conversely, the user can grasp handle 1142 and push the gate 1140 down to at least partially cover interior 1202 formed by the removal of portals 1174, 1176. Product dispensing apparatus 1200 may be suitable for any sort of product that may be stored, transported and dispensed by opening gate 1140 to expose interior 1202. Product dispensing apparatus 1200 is especially suitable for storing and dispensing cylindrical beverage and food containers. However, many product packages, including noncylindrical product packages, may be dispensed using product dispensing apparatus 1200.

Figure 13:
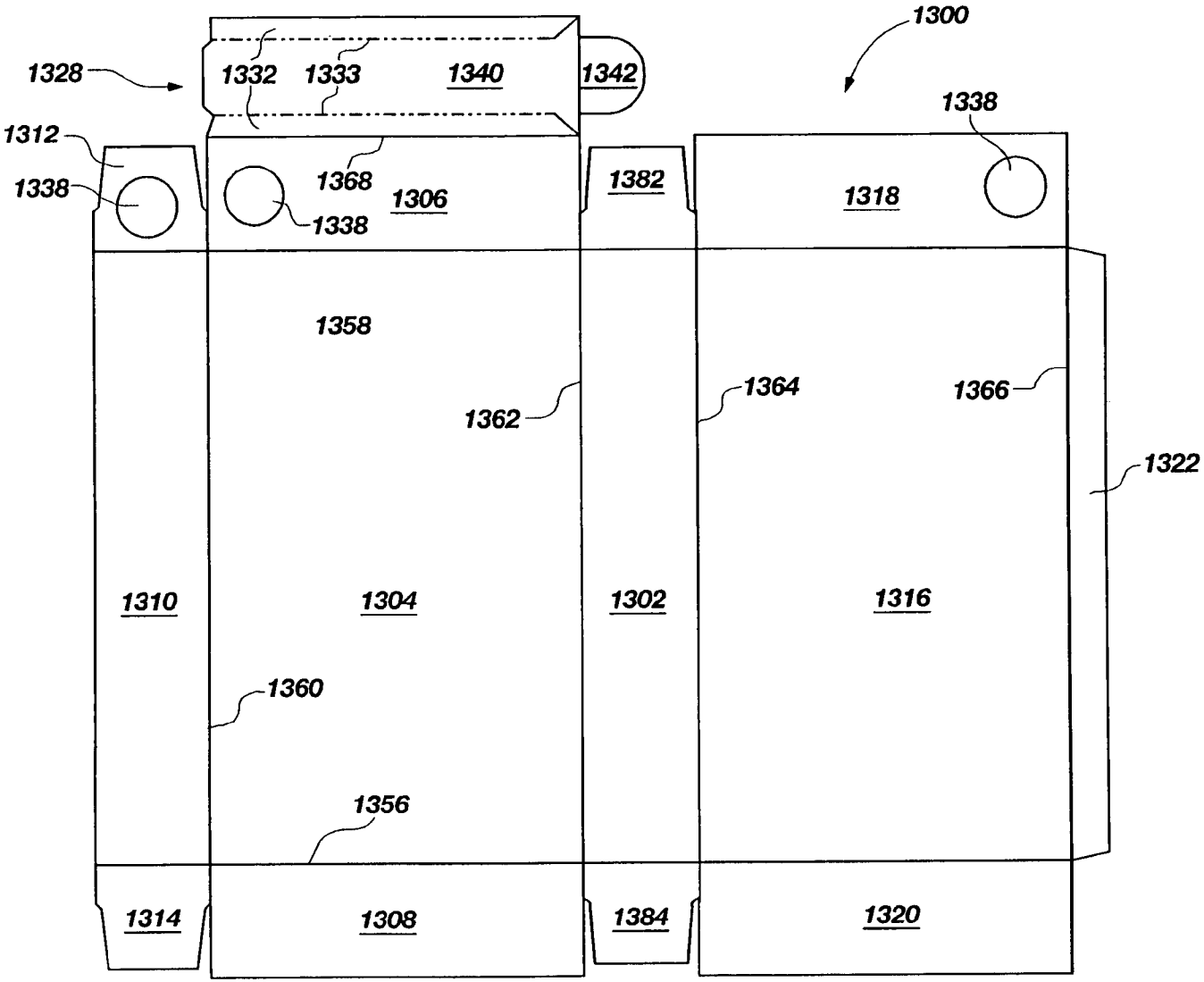
FIG. 13 is a plan view of an embodiment of a two-dimensional unitary form configured for assembly into an embodiment of a product dispensing apparatus as illustrated in FIG. 14, according to the present invention.
Figure 14:
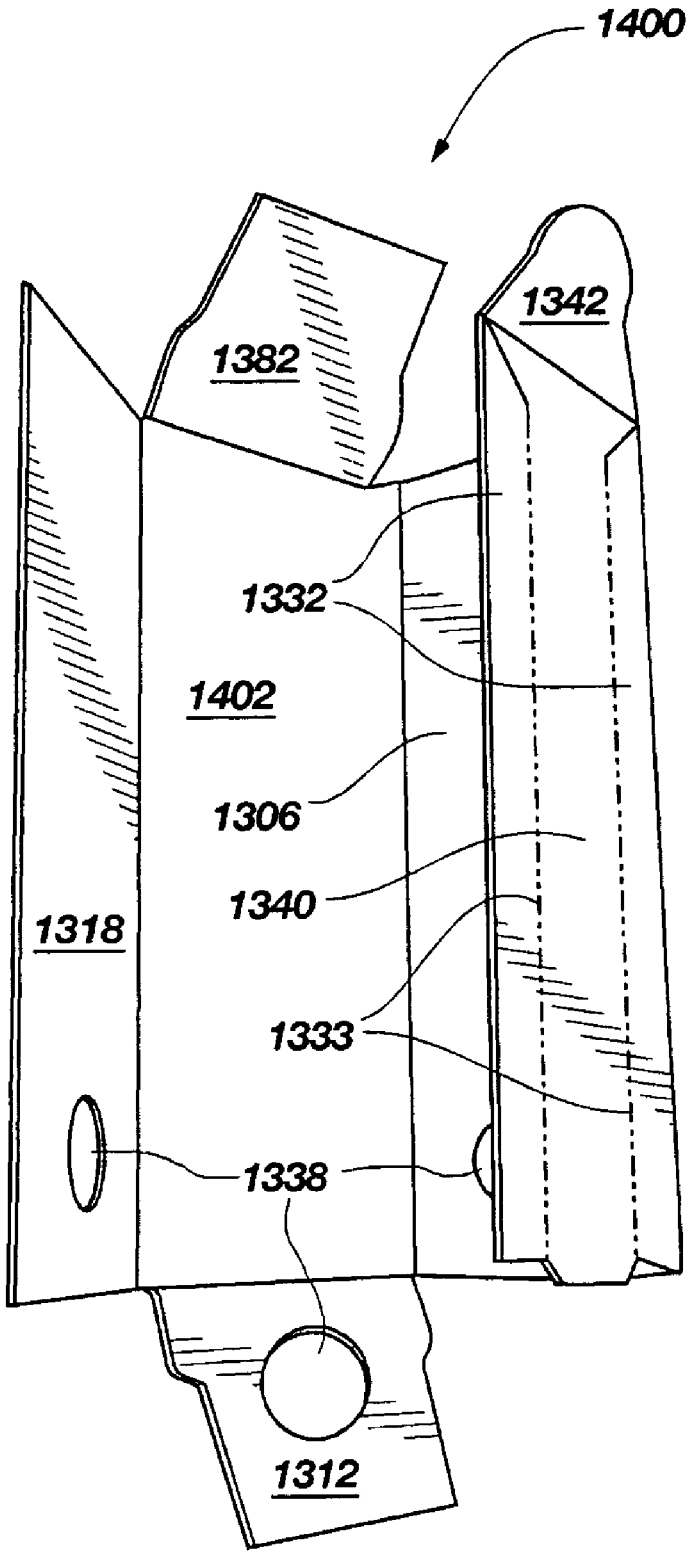
FIG. 14 is a front perspective view of a product dispensing apparatus partially assembled from the two-dimensional unitary form illustrated in FIG. 13 to show gate components according to the present invention.

FIG. 13 is a plan view of an embodiment of a two-dimensional unitary form 1300 configured for assembly into an embodiment of a product dispensing apparatus 1400 as illustrated in FIG. 14, according to the present invention. Body 1300 may be formed of any suitable cardboard or other paper or plastic material, corrugated or otherwise. Body 1300 may include a top panel 1302, a left side panel 1304, a left rear panel 1306, a left front panel 1308, a left bottom panel 1310, a left rear flap 1312, a left front flap 1314, a rear center flap 1382, a front center flap 1384, a right side panel 1316, a right rear panel 1318, a right front panel 1320, a right bottom panel 1322. Body 1300 may also include gate panel, shown generally at 1328 and attached to left rear panel 1306. Body 1300 may also have a first fold line 1356, a second fold line 1358, a third fold line 1360, a fourth fold line 1362, a fifth fold line 1364, a sixth fold line 1366 and a seventh fold line 1368. Assembly of the product dispensing apparatus 1400 from the body 1300 may be facilitated by folding down along all fold lines 1356, 1358, 1360, 1362, 1364, 1366 and 1368. Although body 1300 has been referenced according to panels having identifiers, i.e., top, bottom, left, right, etc., that might suggest only one particular configuration of the product dispensing apparatus formed thereof, the identifiers are merely used for reference and not intended to be limiting in any way. It will, of course, be readily apparent to one of ordinary skill in the art that the panels may be referenced in many other ways and that the product dispensing apparatus 1400, once assembled, can be oriented in any suitable direction.

Gate panel 1328 may further include a gate 1340 attached to a plurality of tabs 1332 by perforations 1333. Gate 1340 is configured to be separated from tabs 1332 during first use by pulling on handle 1342, thereby separating gate 1340 from tabs 1332 along perforations 1333. Perforations 1333 may be appropriately sized cuts or slits in the material from which the body 1300 is formed as shown in FIG. 13.

Alternatively, the perforations 1333 may be slots (not shown) separated by slits (also not shown) and narrow bridges (also not shown, but see FIG. 11). Gate 1340 may further include a handle 1342. Handle 1342 may further include a mechanism (not shown, but see 1146 of FIG. 11) for grasping handle 1342. The tabs 1332 may be of any suitable size such that they can be attached to panels 1306 and 1318.

According to another embodiment of unitary two-dimensional body 1300, gate panel 1328 may be mirrored and attached to right rear panel 1318. According to yet another embodiment, gate panel 1328 may be located where rear center flap 1382 is located. Of course, additional embodiments of unitary two-dimensional body 1300 may include a second gate panel (not shown in FIG. 13) attached to left front panel 1308, right front panel 1320 or in place of front center flap 1384 in a manner analogous to that described above for gate panel 1328.

Left rear flap 1312, left rear panel 1306 and right rear panel 1318 may each include a portal or aperture 1338. Apertures 1338 may be areas cut out of unitary two-dimensional body. Alternatively, apertures 1338 may be areas surrounded at least partially by perforations. In this case, apertures 1338 may be configured to be removed by separating the areas from the body 1300 along the perforations. Selected panels may further include apertures (not shown) for displaying selected indicia according to yet another embodiment of the present invention and as described elsewhere in this detailed description. Gate panel 1328 is folded between left rear panel 1306 and right rear panel 1318 during assembly. The tabs 1332 are affixed to left rear panel 1306 and right rear panel 1318 during assembly. During first use, gate 1340 is separated from tabs 1332 and allowed to slide up and down (or side-to-side based on orientation) within the channel formed by the broken perforations 1333 and left rear panel 1306 and right rear panel 1318.

FIG. 14 is a front perspective view of a product dispensing apparatus 1400 partially assembled from the two-dimensional unitary form 1300 illustrated in FIG. 13 to show gate components according to the present invention. The embodiment of a product dispensing apparatus 1400 shown in FIG. 14 shows handle 1342 on gate 1340 configured for sliding behind left rear panel 1306 and in front of right rear panel 1318. Product dispensing apparatus 1400 includes an interior 1402 for storing products, especially bulk goods such as powders and cereals, although it is not limited to such products. Apertures 1338 are all aligned when the product dispensing apparatus 1400 is assembled. Once the gate 1340 has been separated from tabs 1332 during first use, the product dispensing apparatus 1400 is ready for dispensing. By grasping handle 1342 the user can pull the gate 1340 up thereby exposing the contents within the interior 1402 of product dispensing apparatus 1400 through aligned apertures 1338 which form a portal. Conversely, the user can grasp handle 1342 and slide the gate 1340 down to cover or at least partially cover interior 1402 for storage of the product contained therein. Product dispensing apparatus 1400 may be suitable for any sort of product that may be stored, transported and dispensed by opening gate 1340 to expose interior 1402.

Figure 15:
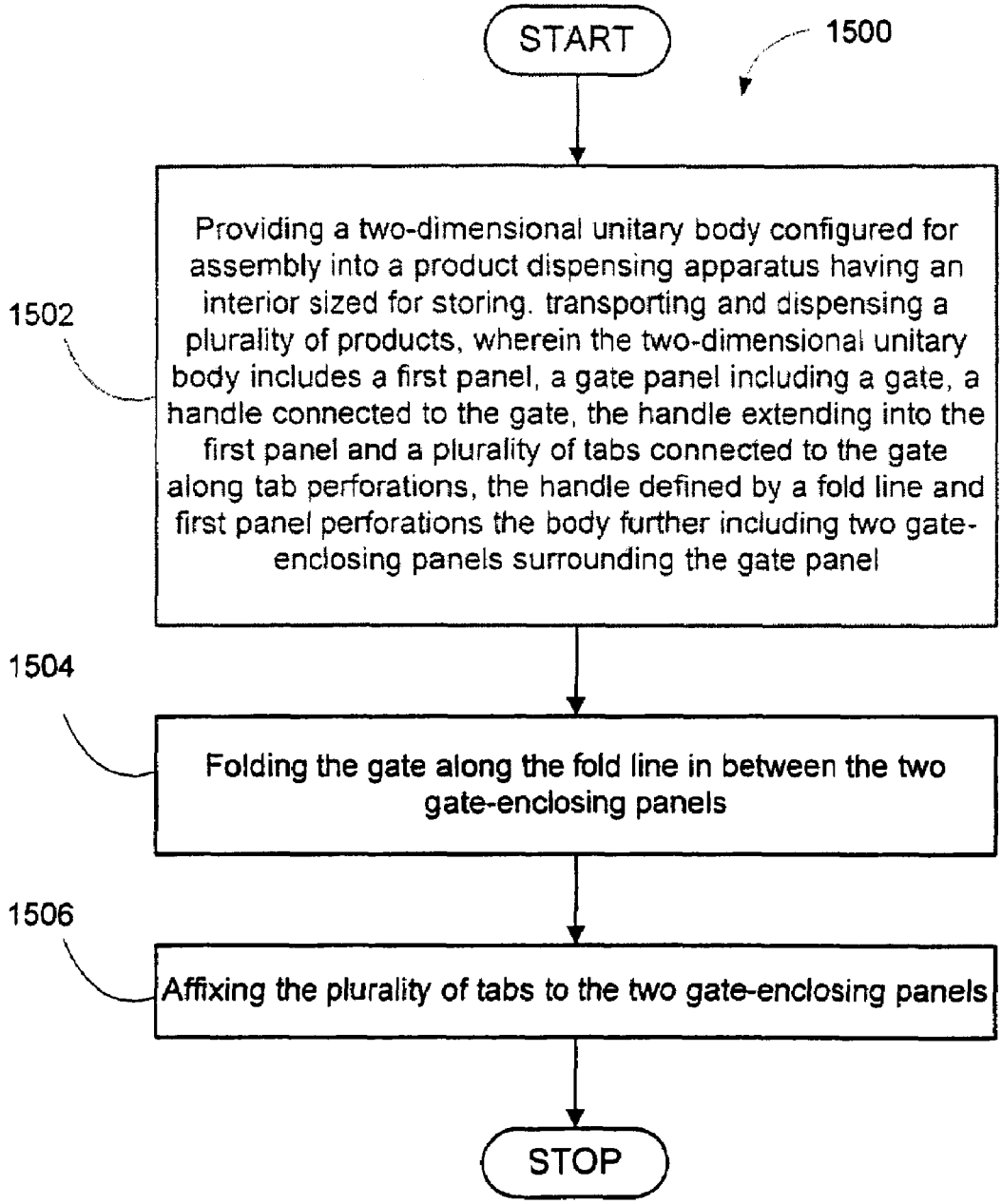
FIG. 15 is a flow chart of an embodiment of a method of forming a movable gate for a product dispensing apparatus.

FIG. 15 is a flow chart of an embodiment of a method 1500 of forming a movable gate for a product dispensing apparatus. Method 1500 may include providing 1502 a two-dimensional unitary form configured for assembly into the product dispensing apparatus having an interior sized for storing, transporting and dispensing a plurality of products. The two-dimensional unitary form may include a first panel, a gate panel including a gate, a handle a plurality of tabs, the handle connected to the gate and extending into the first panel, the plurality of tabs connected to the gate along tab perforations and the handle defined by a fold line and first panel perforations. The two-dimensional unitary form may further include two gate-enclosing panels surrounding the gate panel. Method 1500 may further include placing 1504 the gate in between the two gate-enclosing panels and affixing 1506 the plurality of tabs to the two gate-enclosing panels. Method 1500 may further include separating the handle of the gate from the first panel along the first panel perforations and separating the gate from two gate-enclosing panels along the tab perforations according to another embodiment of method 1500.

Figure 16:
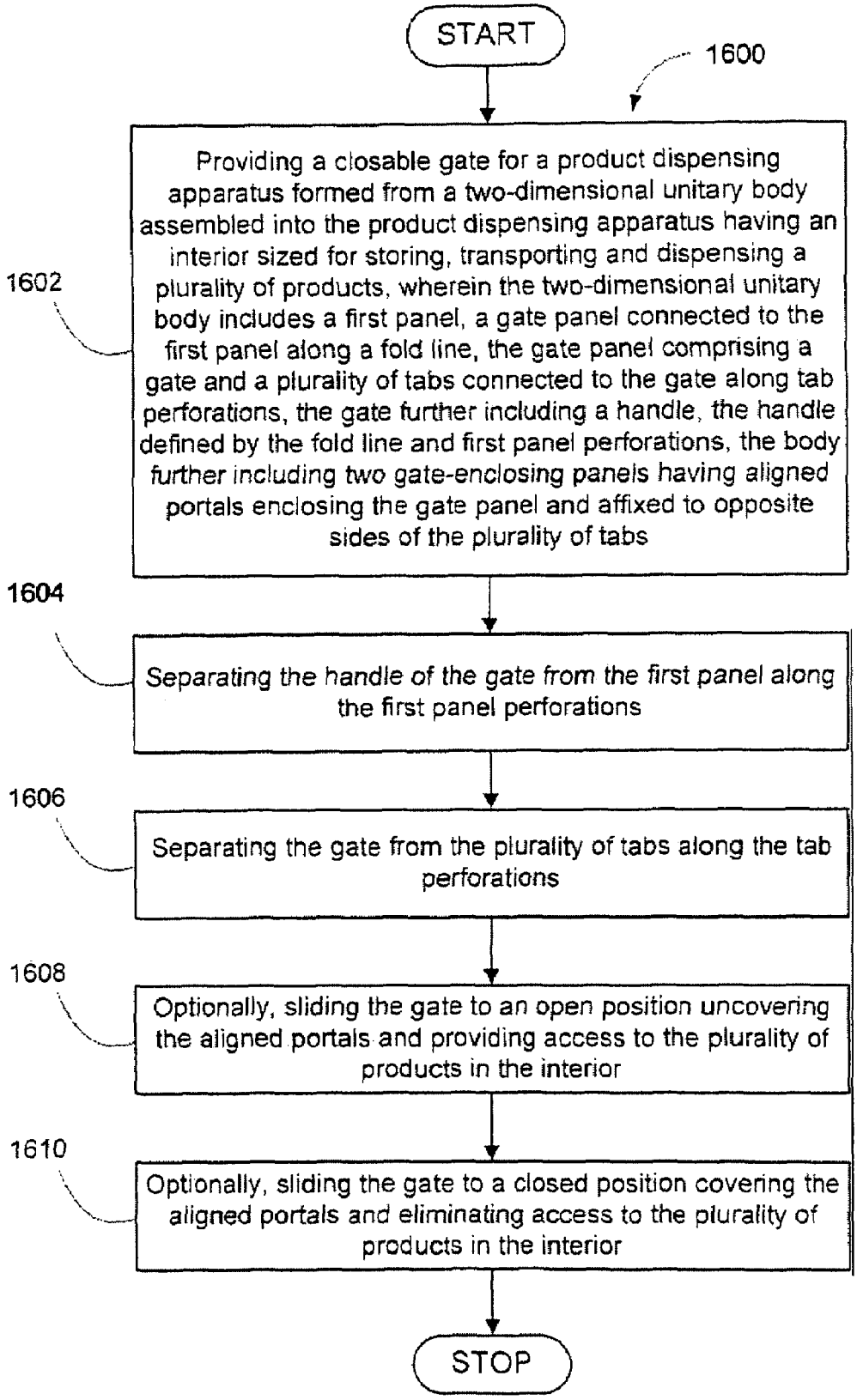
FIG. 16 is a flow chart of an embodiment of a method 1600 of using a movable gate for a product dispensing apparatus according to the present invention.

FIG. 16 is a flow chart of an embodiment of a method 1600 of using a movable gate for a product dispensing apparatus according to the present invention. Method 1600 may include providing 1602 a movable gate for a product dispensing apparatus formed from a two-dimensional unitary form assembled into the product dispensing apparatus having an interior sized for storing, transporting and dispensing a plurality of products. The two-dimensional unitary form may include a first panel and a gate panel connected to the first panel along a fold line and including a gate and a plurality of tabs connected to the gate along tab perforations, the gate including a handle, the handle defined by the fold line and first panel perforations. The two dimensional unitary form may further include two gate-enclosing panels having aligned portals enclosing the gate panel and affixed to opposite sides of the plurality of tabs. Method 1600 may further include separating 1604 the handle of the gate from the first panel along the first panel perforations and separating 1606 the gate from the plurality of tabs along the tab perforations.

Method 1600 may further include, optionally sliding 1610 the gate to an open position, thus, uncovering the aligned portals and providing access to the plurality of products in the interior according to another embodiment of method 1600 of the present invention. Method 1600 may further include optionally, sliding 1612 the gate to a closed position, thus, covering the aligned portals and eliminating access to the plurality of products in the interior according to yet another embodiment of method 1600 of the present invention. Note however that the closed position may only partially over the aligned portals according to an embodiment of the present invention. For example, see FIG. 12 where the gate 1140 only partially covers the portal and access to the interior 1202.

Separating 1604 the handle of the gate from the first panel along the first panel perforations may include inserting a finger into a mechanism for grasping the handle of the gate according to an embodiment of method 1600. Separating 1604 the handle of the gate from the first panel along the first panel perforations may further include pulling the handle away from the first panel thereby separating the handle of the gate from the first panel along the first panel perforations according to another embodiment of method 1600. Separating 1606 the gate from the plurality of tabs may further include pulling the handle in a direction parallel to the tab perforations thereby separating the gate from the plurality of tabs.

The invention, as defined by the claims below, is intended to cover all changes and modifications to the embodiments of the invention as described herein which do not depart from the spirit of the invention. The words "including" and "having," as used in the specification, including the claims, shall have the same meaning as the word "comprising." Although this invention has been described with reference to particular illustrated embodiments, the invention is not limited to the embodiments described. Rather, it should be understood that the embodiments described herein are merely exemplary and that a person skilled in the art may make many variations and modifications without departing from the spirit and scope of the invention as defined by the following claims.

What is claimed is:

1. A gate for a product dispensing apparatus formed from a two-dimensional unitary form configured for assembly into the product dispensing apparatus having an interior sized for storing, transporting and dispensing a plurality of products, wherein the two-dimensional unitary form comprises:

a first panel;

a gate panel connected to the first panel along a fold line and comprising a gate;

two gate-enclosing panels surrounding the gate panel;

wherein the gate panel further comprises a plurality of tabs connected to the gate along tab perforations, the plurality of tabs configured to be affixed between the two gate-enclosing panels during the assembly, the tab perforations defining edges of a channel in which the gate is configured to slide after the tab perforations are broken;

wherein the two gate-enclosing panels are each configured with aligned portals sized for dispensing the products when the gate is in an open configuration; and wherein the aligned portals initially comprise aligned and perforated areas in the two gate-enclosing panels and aligned openings upon removal of the perforated areas.

2. The gate according to claim 1, wherein the gate panel including the plurality of tabs are configured for placement between the two gate-enclosing panels during the assembly of the product dispensing apparatus.

3. The gate according to claim 1, wherein the gate further comprises a handle extending into the first panel and defined by first panel perforations configured for separating the handle of the gate from the first panel during a first use.

4. The gate according to claim 3, wherein the handle further comprises a mechanism for inserting a finger to grasp the handle.

5. The gate according to claim 4, wherein the mechanism comprises one of the following: an opening, perforations outlining an area configured to form an opening when the area is removed, perforations configured to allow insertion of the finger when broken, or a slit configured to allow insertion of the finger therethrough.

6. The gate according to claim 1, wherein the gate of the gate panel is configured for separating from the plurality of tabs along the tab perforations upon first use by pulling the handle.

7. The gate according to claim 1, wherein the gate is further configured to slide either direction between an open position and a closed position while disposed in sliding contact between the two gate-enclosing panels after a first use to provide access to and storage of the plurality of products.

8. The gate according to claim 1, wherein the perforated areas in the two gate-enclosing panels that form openings upon removal are identically aligned.

9. A product dispensing apparatus formed from a two-dimensional unitary form having a plurality of panels and configured for assembly into a container having an interior, wherein the interior is sized for storing, transporting and dispensing a plurality of products, the two-dimensional unitary form, comprising:

a top panel;

two gate-enclosing panels;

a gate panel connected to the top panel along a fold line, the gate panel located between the two gate-enclosing panels, the gate panel including a gate and tabs configured for initially securing the gate between the two gate-enclosing panels during the assembly, the gate configured for separating from the tabs along tab perforations and sliding between the two gate-enclosing panels during use, the tab perforations defining edges of a channel in which the gate is configured to slide after the tab perforations are broken;

wherein the two gate-enclosing panels are each configured with aligned portals sized for dispensing the products when the gate is in an open configuration; and wherein the aligned portals initially comprise aligned and perforated areas in the two gate-enclosing panels and aligned openings upon removal of the perforated areas.

10. The product dispensing apparatus according to claim 9, wherein the gate panel further comprises perforations between the tabs and the gate.

11. The product dispensing apparatus according to claim 10, wherein the perforations comprise micro-perforations.

12. The product dispensing apparatus according to claim 10, wherein the perforations comprise slots separated by narrow bridges.

13. The product dispensing apparatus according to claim 9, wherein the gate further comprises a handle formed into the top panel, outlined in part by perforations in the top panel.

14. The product dispensing apparatus according to claim 13, wherein the gate further comprises a mechanism for inserting a finger to grasp the handle during use and for separating the handle from the top panel along the perforations.

15. The product dispensing apparatus according to claim 14, wherein the mechanism comprises one of the following: an opening, perforations outlining an area configured to form an opening when the area is removed, a slit configured to allow insertion of the finger therethrough, or perforations configured to allow insertion of the finger when the perforations are broken.

16. The product dispensing apparatus according to claim 9, wherein the aligned portals comprise cutouts in the two gate-enclosing panels.

17. The product dispensing apparatus according to claim 9, wherein each of the plurality of products comprises a product or a product in a container.

18. The product dispensing apparatus according to claim 9, wherein the perforated areas in the two gate-enclosing panels that form openings upon removal are identically aligned.

19. A method of forming a movable gate for a product dispensing apparatus, comprising:

providing a two-dimensional unitary form configured for assembly into the product dispensing apparatus having an interior sized for storing, transporting and dispensing a plurality of products, wherein the two-dimensional unitary form comprises:

a first panel;

a gate panel including a gate, a handle, a plurality of tabs, the handle connected to the gate and extending into the first panel, plurality of tabs connected to the gate along tab perforations, the handle defined by a fold line and first panel perforations, the tab perforations defining edges of a channel in which the gate is configured to slide after the tab perforations are broken;

two gate-enclosing panels surrounding the gate panel;

wherein the two gate-enclosing panels are each configured with aligned portals sized for dispensing the products when the gate is in an open configuration; and wherein the aligned portals initially comprise aligned and perforated areas in the two gate-enclosing panels and aligned openings upon removal of the perforated areas;

placing the gate panel in between the two gate-enclosing panels; and affixing the plurality of tabs to the two gate-enclosing panels.

20. The method of forming a movable gate according to claim 19, further comprising:

separating the handle of the gate from the first panel along the first panel perforations; and separating the gate from two gate-enclosing panels along the tab perforations.

* * * * *